US005680693A

United States Patent [19]

Griebel et al.

[11] Patent Number: 5,680,693

[45] Date of Patent: Oct. 28, 1997

[54] METHOD OF MAKING AN INDUCTOR

[75] Inventors: Arthur H. Griebel; William D. West, both of Troy, Mich.; Jerry R. Dunn, Boaz, Ala.

[73] Assignee: Tocco, Inc., Boaz, Ala.

[21] Appl. No.: 487,896

[22] Filed: Jun. 7, 1995

Related U.S. Application Data

[62] Division of Ser. No. 173,886, Dec. 27, 1993, Pat. No. 5,451,749.

[51] Int. Cl.[6] ..... H01F 41/00

[52] U.S. Cl. ..... 29/602.1; 29/609; 219/639; 219/673

[58] Field of Search ..... 29/602.1, 607, 29/825; 219/609, 639, 673, 677

[56] References Cited

U.S. PATENT DOCUMENTS

| | | | |
|---|---|---|---|
| 2,743,345 | 4/1956 | Seulen et al. | 219/10.43 |
| 3,188,440 | 6/1965 | Wokas | 219/10.43 |
| 3,210,510 | 10/1965 | Cary | 219/10.43 |
| 3,554,514 | 1/1971 | Preyer | 266/4 |
| 3,619,540 | 11/1971 | Soworowski | 219/10.71 |
| 4,456,803 | 6/1984 | Kaneda et al. | 219/8.5 |
| 4,535,211 | 8/1985 | Carter | 219/10.49 |

FOREIGN PATENT DOCUMENTS

| | | |
|---|---|---|
| 1721844 | 3/1992 | U.S.S.R. . |
| 613322 | 11/1948 | United Kingdom . |

*Primary Examiner*—Carl E. Hall
*Attorney, Agent, or Firm*—Vickers, Daniels & Young

[57] ABSTRACT

An inductor for inductively heating bearing surfaces of a crankshaft is machined from a block of copper to provide parallel, closely spaced and integrally joined inductor block portions having machined coolant passages therein. The machined inductor is rigidly supported between juxtaposed side plates having portions of the inner surfaces thereof machined to provide recesses which receive the inductor and in which the inductor is clampingly engaged between the plates. Positioning fingers are supported by the side plates to accurately position the active face of the inductor relative to a bearing surface to be heated, and tubular leads extend upwardly between the side plates for connecting the inductor across a source of power. An inlet conduit for coolant extends laterally between the side plates, and the tubular leads provide outlets for coolant flow from the inductor.

6 Claims, 17 Drawing Sheets

METHOD OF MAKING AN INDUCTOR

This is a division of application Ser. No. 173,886 filed Dec. 27, 1993, now U.S. Pat. No. 5,451,749.

BACKGROUND OF THE INVENTION

The present invention relates to the art of induction heating and, more particularly, to an inductor and inductor assembly for heating bearing surfaces of a crankshaft and methods of making such an inductor.

The present invention finds particular utility in conjunction with the inductive heating of the bearing surface of a crankshaft journal pin and will be described with particular reference thereto. At the same time, however, it will be appreciated that the invention is applicable to the induction heating of the bearing surface of the crankshaft journal as well as annular bearing surfaces of other workpieces.

In conjunction with the induction hardening of automotive crankshaft bearing surfaces, there is an increasing demand by the automotive industry for selectively hardening crankshaft pin and main bearing surfaces. Such selective hardening has been motivated by the demand in the automotive sector for higher output engines which impose increased requirements on bearing loads and structural strength. Moreover, newer engine designs are being reduced in size while maintaining the same or an increased output capability which requires operation of the engines at higher torque and stress levels. At the same time, the reduction in size results in a substantially reduced axial length of the crankshaft pin and main bearings.

It is of course known to inductively heat the bearing surface of a crankshaft journal pin through the use of an arcuate inductor of fabricated tubular construction positioned relative to the bearing surface as the latter orbits during a heat treating operation. In order to obtain efficient operation and high quality heat treating of crankshaft bearing surfaces, the active element of the inductor must be dimensionally accurate and consistently positioned accurately relative to the bearing surface so as to consistently duplicate the desired hardening results during repeated use of the induction heating apparatus. Even if the active inductor element is supported for tweaking adjustment relative to the bearing surface to be inductively heated, such adjustment impacts consistent quality assurance since it involves a manual operation and accordingly can vary and change from one equipment setup to another.

As shown in U.S. Pat. No. 3,188,440 to Wokas, for example, it has been the practice heretofore to manufacture the active inductor elements of an inductor for inductively heating crankshaft bearing surfaces from fabricated or formed tubing, and there are a number of problems and disadvantages attendant to this practice. To begin with, formed or fabricated tubing has limited dimensional accuracy due, at least in part, to the bending and/or cutting and/or brazing operations of which there are a considerable number in connection with fabricating the active elements of an inductor such as that disclosed in the Wokas patent. Further, brazed joints between tubing sections lower efficiency and provide areas of stress concentration which lead to early failures, and the latter is dependent to a considerable extent on the skill of the person doing the brazing, whereby a high degree of brazing skill is required in an effort to minimize such failures. Still further, brazed joint interfaces are of higher resistivity resulting in thermally induced stress and higher thermal loss during operation of the inductor. A further disadvantage of fabricated tubular inductors resides in the fact that the internal cooling path includes a number of sharper angular directional changes which can impede the flow of cooling water therethrough, thus reducing the desired thermal maximum transfer of heat to the cooling Water and result in undesirable surface/interface conditions. Still further, to meet the new requirements for inductively heating axially shorter bearing surfaces, space availability is a factor which compromises all of the foregoing problems. Still further, fabricated tubing limits the optimum geometry of the active inductor element as well as the optimum geometry of the internal cooling water passages and, as a result, both cooling and durability of the inductor are compromised because the thermal energy generated within the inductor cannot be optimally effectively transferred to the cooling water. It is known, as shown in U.S. Pat. No. 4,535,211 to Carter, to construct a "single shot inductor" for inductively heating axle shafts from a single block of copper so as to eliminate brazed joints between adjacent inductor sections and obtain improved accuracy with respect to dimensional tolerances. The physical structure of a "single shot inductor", however, is totally different from that of an inductor for inductively heating a narrow crankshaft bearing surface and accordingly, as will become apparent hereinafter, the manufacturing techniques required to produce an inductor for inductively heating a crankshaft bearing surface in accordance with the present invention vary considerably from that for producing a "single shot inductor".

A further disadvantage with crankshaft bearing surface induction heating assemblies heretofore provided, such as that of Wokas, is that the active inductor element is not supported with sufficient structural integrity to assure consistency with respect to maintaining the proper position thereof relative to the moving bearing surface, especially with respect to the pin bearing which is orbiting during the induction heating operation. While Wokas provides side plates supporting guide fingers for positioning the active inductor element relative to the bearing surface, the inductor element is supported in suspension relative to the bearing surface by the inductor and coolant line leads connected thereto. The latter are between and spaced from the side plates and, accordingly, the active inductor element can move both axially and radially relative to the guide fingers and thus the bearing surface, and such relative displacement capability is a detriment to maintaining proper positioning of the inductor element relative to the bearing surface. Moreover, the spaced relationship between the inductor leads and side plates in the Wokas inductor assembly would promote stray heating of the side plates which would reduce the efficiency with respect to inductively heating of the bearing surface through the active inductor element. Furthermore, this heating causes mechanical movement which causes changes in inductor location accuracy. These changes can be inconsistent transitional mechanical movements plus sequentially additive changes, all of which equate to thermal ratcheting.

SUMMARY OF THE INVENTION

In accordance with one aspect of the present invention, an improved inductor and method of making the same is provided for inductively heating a bearing surface of a crankshaft and which inductor and method advantageously overcome or minimize the foregoing and other problems heretofore encountered in connection with such inductors and the construction thereof.

In accordance with another aspect of the invention, an improved inductor assembly is provided by which structural integrity is maintained with respect to supporting the inductor, and stray heating of the support structure is minimized or eliminated to optimize the inductive heating efficiency and dimensional accuracy of the active inductor elements by which the bearing surface is inductively heated.

An inductor in accordance with one aspect of the present invention is constructed from a single, solid block of electrically conductive material, preferably copper, which is machined to provide a singular modular component having parallel, closely spaced inductor block portions integrally united at the active inductor element portion of the inductor block. Such construction advantageously enables minimizing the axial thickness of the inductor relative to the bearing surface axis of the crankshaft to be inductively heated thereby. Construction of the inductor can incorporate lower cost computer numerically controlled machining techniques (CNC) which provide a unique iterative process by which the inductor is machined in stages to a final dimensionally precise shape. More particularly in this respect, the initial solid block is pre-machined to a basic outline configuration, cooling passage recesses are machined in the axially opposite faces of the block and joined at appropriate locations by drilling through the block, covers are brazed to close the recesses and thus provide cooling passages for the inductor, and the block is then machined to its final dimensional shape including that of the active inductor elements of the inductor. This substantially eliminates thermal distortion due to brazing. Thereafter, the block is sliced between the axially opposite faces thereof to form inductor block portions which are integrally united at the active inductor element portions thereof, and one of the inductor block portions is divided to provide the inductor with terminal ends for connection to a source of power. It will be appreciated that the foregoing construction of an inductor using CNC machining techniques is applicable to inductors in which the aforementioned integral portions uniting the active inductor element portions are of considerable length which corresponds to the width of the slice between the axially opposite faces of the block. If this dimension is such that an unreasonable amount of the block material has to be removed, and removal would be wasteful, the block can be sliced completely through to provide the inductor block portions which would then be united at the active inductor element portions thereof by blocks facially brazed therebetween to provide the desired dimension between the inductor block portions.

Such construction of the inductor advantageously provides substantial improvement in the dimensional control of the precisely produced heating face profile of the active inductor elements. Preferably, the inductor block is machined to provide integral mounting lugs, or other gaged locating surfaces, extending laterally outwardly from the active inductor elements to provide part of an accurate positioning and support arrangement for the inductor, and the CNC machining techniques advantageously provide low cost techniques for repeatedly producing identical inductors in which these lugs or other locating surfaces as well as the profile face of the active inductor elements are machined with repeatedly consistent accuracy, thus to obtain consistent duplication in manufacture, consistent operational results in use, and assurance of proper positioning of the heating face profile of the active inductor elements relative to the bearing surface without tweaking at the time of assembly. Moreover, machining of the coolant passage recesses in the opposite faces of the inductor block enables optimizing the geometry of the cooling water passages to obtain maximum flow and a flow geometry that enhances maximum thermal transfer. Still further, brazed connections in critical areas of the inductor are eliminated, thus improving structural integrity, fatigue life and greater efficiency while, at the same time, optimizing the internal cooling surface geometry so as to increase the cooling efficiency, resulting in minimizing thermal generated movement during operation.

An inductor assembly according to the invention comprises an inductor, preferably constructed as described above, mounted between a pair of side plates which provide the mechanical structural members for locating and maintaining alignment of the inductor with respect to the crankshaft bearing surface through locating shoes which mechanically contact the bearing surface. The side plates have facially engaging inner sides which are machined using CNC techniques to provide recesses which, in accordance with one aspect of the invention, receive supporting blocks of insulating material between which the inductor is received and by which the inductor is clampingly interengaged between the side plates. In accordance with another aspect, the side plate are of insulating material and the recesses are machined to closely receive and clampingly engage the inductor therebetween. In either event, the substantial stresses generated by the orbiting rotation of the pin bearing are imposed on the side plates through the positioning shoes. With the clamping support of the inductor between the side plates, the positioning shoes assure maintaining the desired accuracy with respect to the spacing of the active inductor elements from the bearing surface. Preferably, as mentioned hereinabove, the inductor includes integral mounting lugs or other locating surfaces adjacent the active inductor elements, and the latter are clampingly interengaged between the plate members either directly or through the use of corresponding support blocks of insulating material, thus to further assure obtaining and maintaining accuracy with respect to positioning of the active inductor elements relative to the bearing surface.

The inductor assembly further includes tubular leads for connecting the inductor across a source of power and which leads are connected to the terminal ends of the inductor and extend between the side plates in closely spaced relationship to one another with specific orientation to a point of connection with contacts by which the inductor assembly is coupled with a source of power. The side plates are manufactured of low resistivity copper, brass or a non-metallic insulating material such as G-10 to substantially reduce internal inductive heating losses for optimal dimensional stability, and the leads between the side plates are parallel thereto and closely coupled to reduce transverse flux coupling of the side plates and/or crankshaft to minimize inductive heating of the side plates. A tubular coolant supply conduit is connected with the inductor to deliver coolant to the coolant passageways therein and also extends between the side plates and, in the preferred embodiments the tubular leads for the inductor provide outlets for the coolant. Preferably, the inner sides of the side plates are recessed to provide quenching liquid chambers having apertured plates supported therein for directing quenching liquid against the inductively heated bearing surface. Quenching liquid supply conduits are clampingly engaged between the side plates for delivering quenching liquid to the chambers and, preferably, a portion of the quenching liquid is directed to the upper positioning shoe during the quenching operation to reduce operating thermal stresses for the latter and for the adjacent support area provided on the side plates for the finger.

The inductor design and the manufacturing process therefor as well as the design of the side plates and the assembled interrelationship thereof with the inductor and inductor leads results in substantial improvements in performance in conjunction with inductively heating a crankshaft bearing surface, quality assurance with respect to the manufacturing process, and maintainability with respect to both of the latter improvements. These improvements are the result of incorporating CNC machining techniques in the manufacturing process and, in conjunction therewith, incorporating the required structural-mathematical analysis of inductor electro-magnetic field generation and proper coolant flow so as to optimize the design for maximum inductor efficiency and virtual elimination of induction heating of the support structure, thus to obtain optimum dimensional stability.

It is accordingly an outstanding object of the present invention to provide an improved inductor for inductively heating a bearing surface of a crankshaft.

Another object is the provision of an inductor of the foregoing character in which the active inductor element or elements have improved dimensional accuracy so as to optimize the efficiency thereof with respect to inductively heating the bearing surface.

Yet another object is the provision of an inductor of the foregoing character having improved structural integrity with respect to areas subjected to mechanical and thermal stress during an induction heating operation.

Yet another object is the provision of an inductor of the foregoing character having coolant passageways therein which optimize coolant velocity and coolant boundary layer interface conditions and thereby enhance maximum transfer of thermal energy to the coolant flowing therethrough.

Still a further object is the provision of an inductor of the foregoing character which is devoid of brazed connections in critical areas, thus to improve the structural integrity and fatigue life of the inductor while reducing resistivity and thus thermal loss and thermally inducted stress.

A further object is the provision of an inductor assembly including an inductor of the foregoing character clampingly supported between parallel plate members including positioning fingers for locating the active inductor elements of the inductor relative to a crankshaft bearing surface.

Yet a further object is the provision of an inductor assembly of the foregoing character in which the inductor and the active inductor elements thereof are clampingly engaged between the side plates to optimize positional stability of the active inductor elements relative to the bearing surface, and wherein the inductor leads and side plates are structurally interrelated to minimize inductive heating of the side plates and thus stray heating of the support assembly.

Still a further object is the provision of an inductor assembly of the foregoing character wherein the side plates provide optimum mechanical stability with respect to supporting the inductor and inductor leads, substantially reduce internal inductive heating losses to optimize dimensional stability, and provide for minimizing the dimension of the inductor assembly in the direction parallel to the crankshaft axis.

Another object of the invention is to provide a method of making an inductor for inductively heating a bearing surface of a crankshaft from a single piece or pieces of electrically conductive material to provide improved strength and electrical characteristics, improved coolant flow and transfer of thermal energy to the coolant, and repeatedly obtainable dimensional preciseness with respect to the shape thereof and especially the profile face of the active inductor element portion thereof.

Yet another object is to provide an inductor which eliminates tweaking upon installation, provides the ability to consistently produce metallurgical results to meet higher levels of quality assurance, enables reducing expensive quality audit requirements such as the cutting of samples, and provides a tool which is more effective for integration with improved, in process, monitoring and control systems.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF THE PREFERRED EMBODIMENTS

Figure 1:
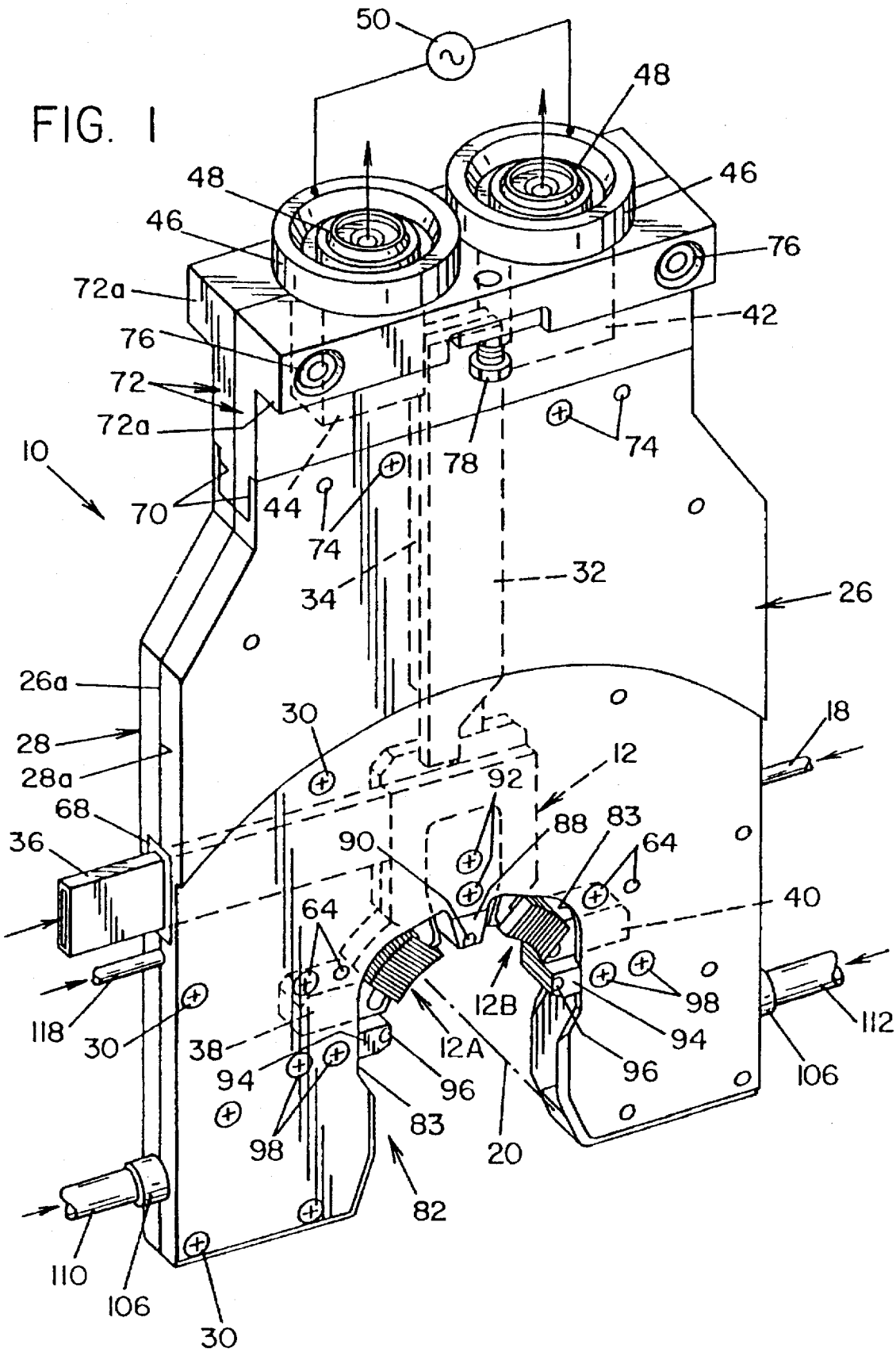
FIG. 1 is a perspective view of an inductor assembly constructed in accordance with the present invention.
Figure 2:
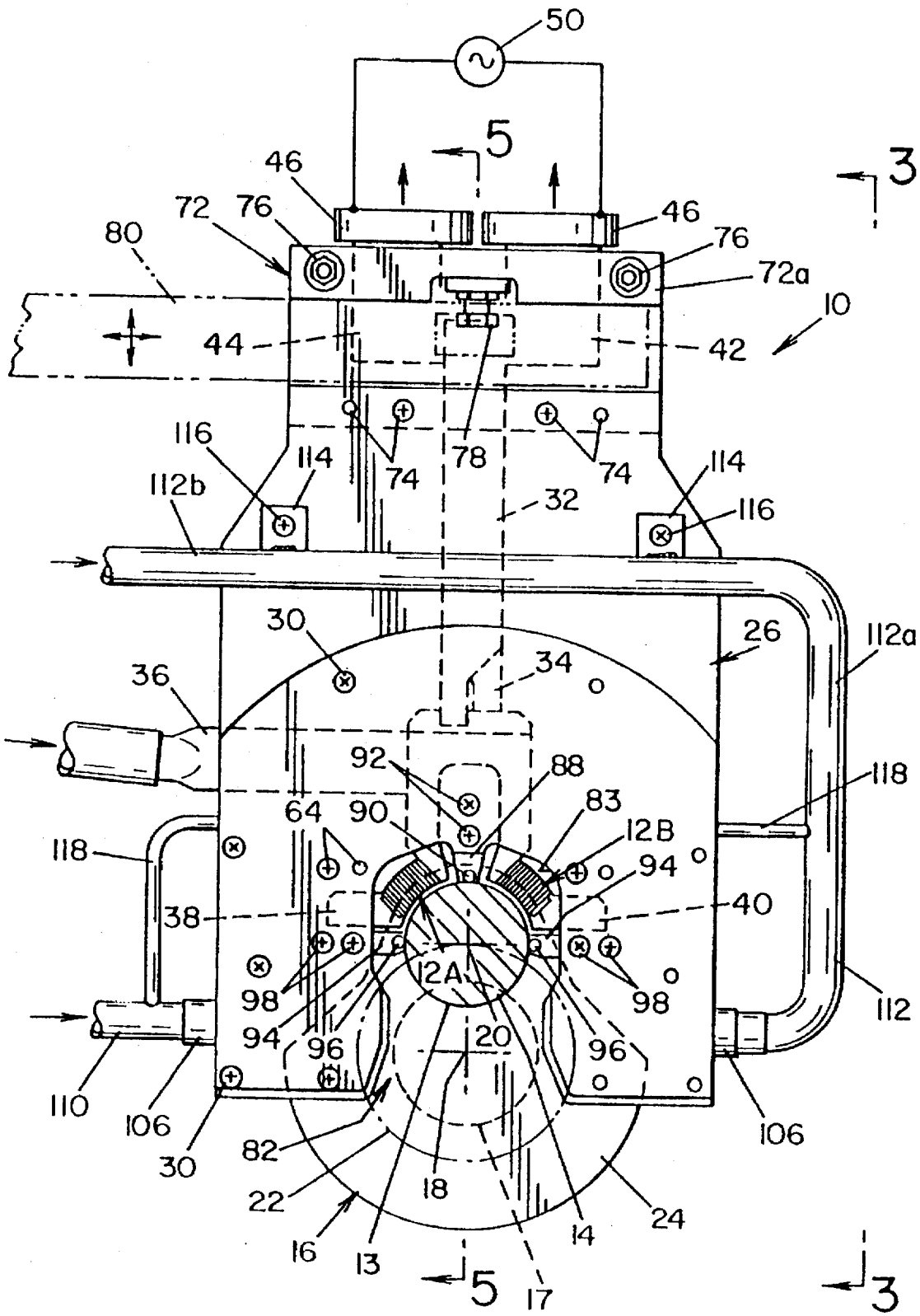
FIG. 2 is an elevation view of one side of the inductor assembly and showing the assembly in inductively coupled relationship with respect to a crankshaft pin bearing to be inductively heated thereby.

Referring now in greater detail to the drawings wherein the showings are for the purpose of illustrating preferred embodiments of the invention only and not for the purpose of limiting the invention, FIGS. 1–9 of the drawing illustrate an inductor assembly 10 including an inductor 12 for inductively heating the bearing surface 13 of the pin bearing 14 of a crankshaft 16 which includes a journal 17 having a journal axis 18. Pin bearing 14 has an axis 20 and, during the induction heating of bearing surface 13 pin bearing 14 and thus axis 20 thereof orbit about journal axis 18 as represented by broken line 22 in FIG. 2 showing the orbital path of axis 20. As is well known, crankshaft 16 includes axially spaced, radially extending throws 24 between which the pin bearing extends and with respect to which the bearing surface 13 of the pin bearing is integrally joined by fillets 13*a*. Accordingly, it will be appreciated that the inductive heating of bearing surface 13 in connection with the ensuing description can be inclusive of the fillet areas.

Inductor assembly 10 further includes a pair of copper side plates 26 and 28 interconnected by threaded fasteners 30 and having inner sides including planar, facially engaging portions 26*a* and 28*a*, respectively. As will become parent hereinafter, the inner sides of plates 26 and 28 are also provided with opposed recesses by which inductor 12 and other components of the inductor assembly including inductor leads 32 and 34 and coolant inlet conduit 36 are clampingly interengaged between and supported by the plates. As will be seen from FIGS. 10 and 11, inductor 12, which will be described in greater detail hereinafter, is of inverted generally U-shaped configuration relative to axis 20 and has arcuate active inductor portions 12A and 12B at the bottom end thereof terminating in laterally outwardly extending mounting lugs. 38 and 40, respectively. Inductor leads 32 and 34 are copper tubes of rectangular cross-section brazed to and extending upwardly from the top of inductor 12 as described in greater detail hereinafter. Leads 32 and 34 are in parallel relationship to one another and have upper ends respectively brazed to copper contact flange receiver blocks 42 and 44 which in turn receive a corresponding annular contact flange 46 and neoprene gasket 48. Contact flanges 46 and gaskets 48 provide a quick connect-disconnect coupling component for connecting the inductor leads and thus inductor 12 across a source of power 50 and to a source of coolant, not shown, and the contact flanges and corresponding contact flange receiver have openings therethrough, not designated numerically, communicating with the upper ends of inductor leads 32 and 34 to facilitate the outflow of coolant circulated through the inductor as set forth more fully hereinafter.

Figure 10:
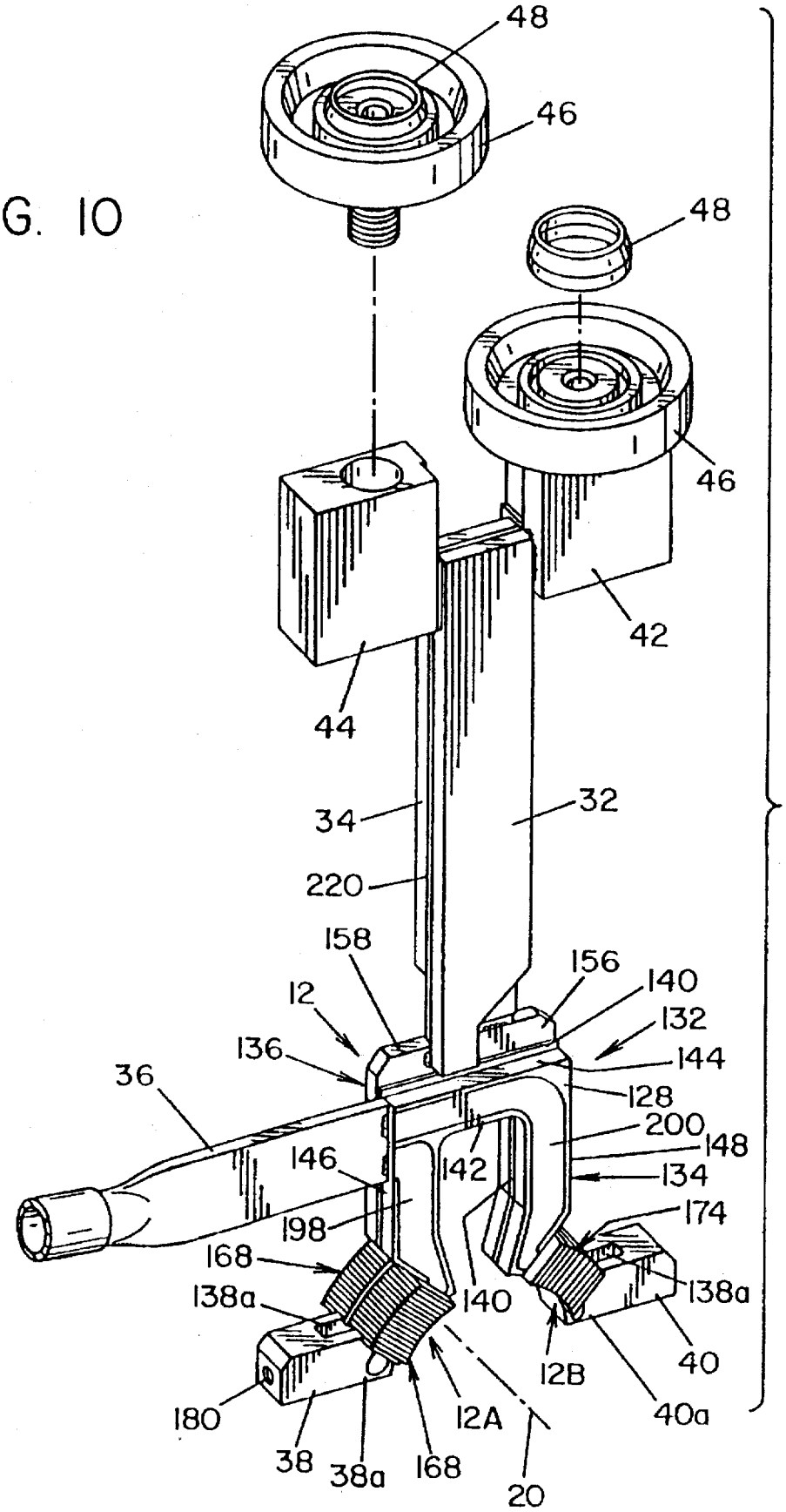
FIG. 10 is a perspective view of one side of the inductor of the inductor assembly and the electrical leads and coolant inlet conduit connected thereto.
Figure 11:
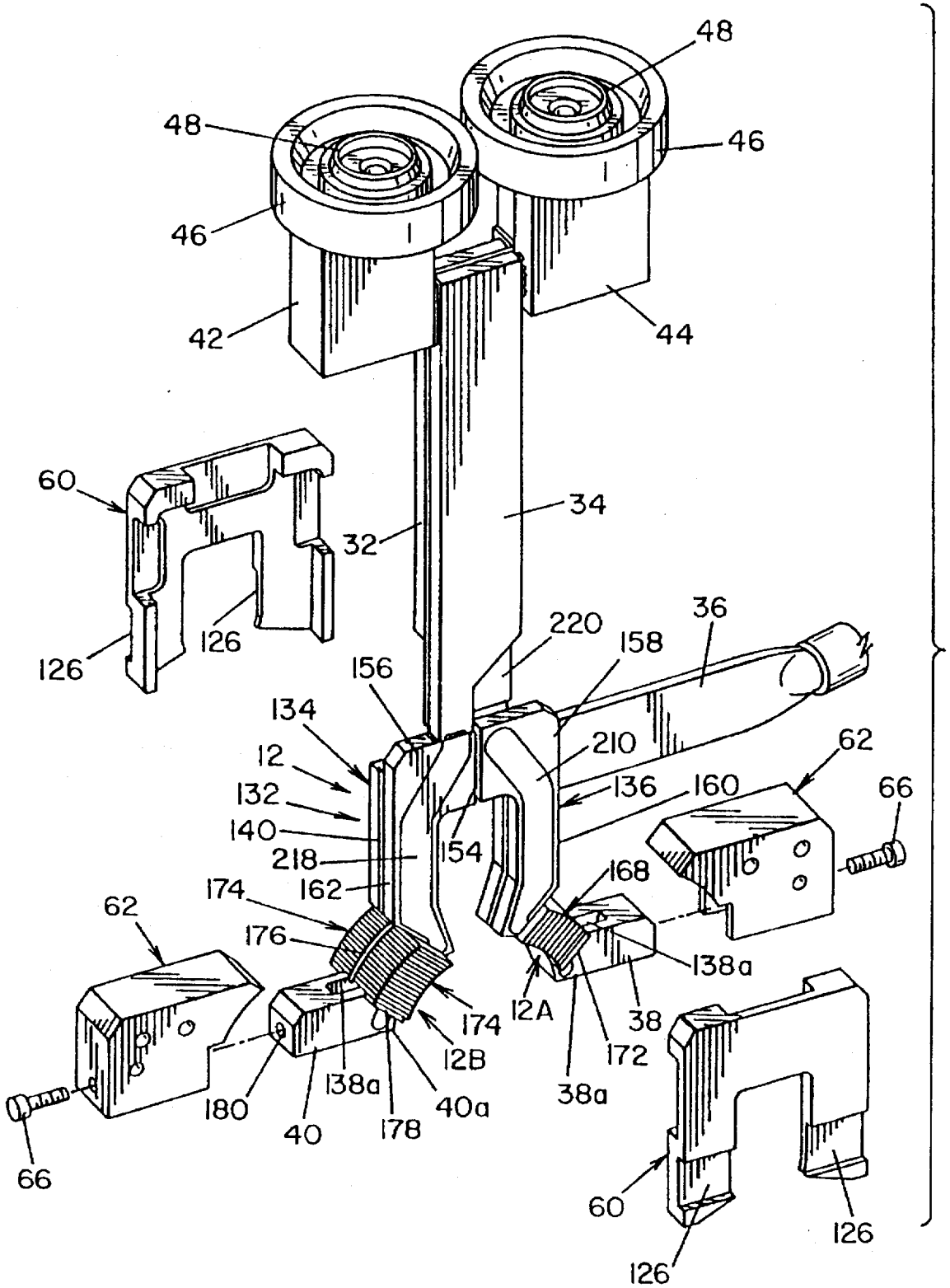
FIG. 11 is a perspective view similar to FIG. 10 of the opposite side of the inductor and showing the locator and support blocks by which the inductor is engaged between the side plates of the assembly.

Referring again to FIGS. 1–9 together with FIGS. 10 and 11, the inner sides of side plates 26 and 28 are milled to provide opposed recesses 52 for the upper portion of inductor 12, opposed recesses 54 for inductor leads 32 and 34, opposed recesses 56 for coolant inlet conduit 36, and opposed recesses 58 for inductor mounting lugs 38 and 40. The upper portion of inductor 12 and the lower ends of leads 32 and 34 connected thereto are clampingly engaged between the side plates by a pair of locator blocks 60 of G-10 insulating material each received in a corresponding one of the recesses 52 so as to clampingly engage the axially opposite sides of the upper portion of the inductor therebetween. Mounting lugs 38 and 40 are clampingly captured between the side plates by corresponding clamping blocks 62 of G-10 insulating material received in recesses 58 and, preferably, secured therein between the side plates by threaded fasteners 64. The outer ends of clamp blocks 60 and mounting lugs 38 and 40 receive corresponding threaded fasteners 66 by which the mounting lugs and thus the bottom end of inductor 12 are rigidly secured to clamp blocks 62 and in turn to the side plates by the fastening of the clamp blocks therebetween by fasteners 64. Inductor coolant inlet conduit 36 is clampingly interengaged between the side plates by a pair of support blocks 68 of G-10 insulating material received in recesses 56 and clampingly engaging the conduit therein, and the inner sides of the side plates at the upper ends thereof are provided with milled recesses 70 receiving the lower ends of a pair of clamping blocks 72 of G-10 insulating material by which contact flange receivers 42 and 44 and thus the upper ends of inductor leads 32 and 34 are clampingly interengaged between the side plates. The lower ends of blocks 72 are clampingly secured in recesses 70 by threaded fasteners 74. The upper ends of the blocks include legs 72*a* extending in axially opposite directions relative to one another, and the blocks are interconnected at the upper ends thereof by nut and bolt assemblies 76 extending through legs 72*a*. The undersides of legs 72*a* are provided with mounting bolt arrangements 78 by which the inductor assembly is secured to a support therefor as is schematically indicated by numeral 80 in FIGS. 2 and 3.

Side plates 26 and 28 of the inductor assembly are adapted to support inductor 12 and the active inductor elements 12A and 12B thereof relative to bearing surface 13 during the induction heating of pin bearing 14. For this purpose, the lower ends of side plates 26 and 28 are provided with inverted, generally U-shaped windows 82 adapted to receive pin bearing 14, and the arcuate, active inductor element portions 12A and 12B of inductor 12 are exposed radially inwardly of peripheral edges 83 of the windows. The inner sides of side plates 26 and 28 are milled to provide downwardly open U-shaped flanges 84 which together provide a pocket for an upper positioning finger comprising a shoe 88 of stainless steel having an insert 90 of carbon, ceramic or other suitable material in the lower end thereof for engaging bearing surface 13 of pin bearing 14. Pocket 86 accurately locates the positioning finger relative to axis 20 so as to provide the appropriate air gap between bearing surface 13 and active inductor element portions 12A and 12B and, preferably, to enhance the preciseness of the location of the positioning finger, the latter is fastened in pocket 86 between side plates 26 and 28 by threaded fasteners 92. Side plates 26 and 28 also support a pair of positioning fingers extending laterally inwardly of edges 83 of windows 82 on diametrically opposite sides of axis 20 and which fingers include stainless steel shoes 94 and corresponding inserts 96 of carbide, ceramic or other suitable material. Shoes 94 are disposed between the side plates in recesses 58 beneath clamping blocks 62 and are secured in place between the side plates by corresponding threaded fasteners 98. Inserts 96 engage against diametrically opposite sides of bearing surface 13 and, together with insert 90 of the upper positioning finger precisely position active inductor element portions 12A and 12B relative to the bearing surface so as to optimize the inductive heating thereof. It will be appreciated that the use of CNC machining techniques to form the various recesses in the inner sides of side plates 26 and 28, including the flanges 84 providing pocket 86, and for drilling and tapping the openings for the various threaded fasteners, not only assures the necessary precision with respect to locating the inductor relative to pin bearing 14 but also the ability to repeatedly obtain such preciseness from one inductor assembly to the next.

Figure 3:
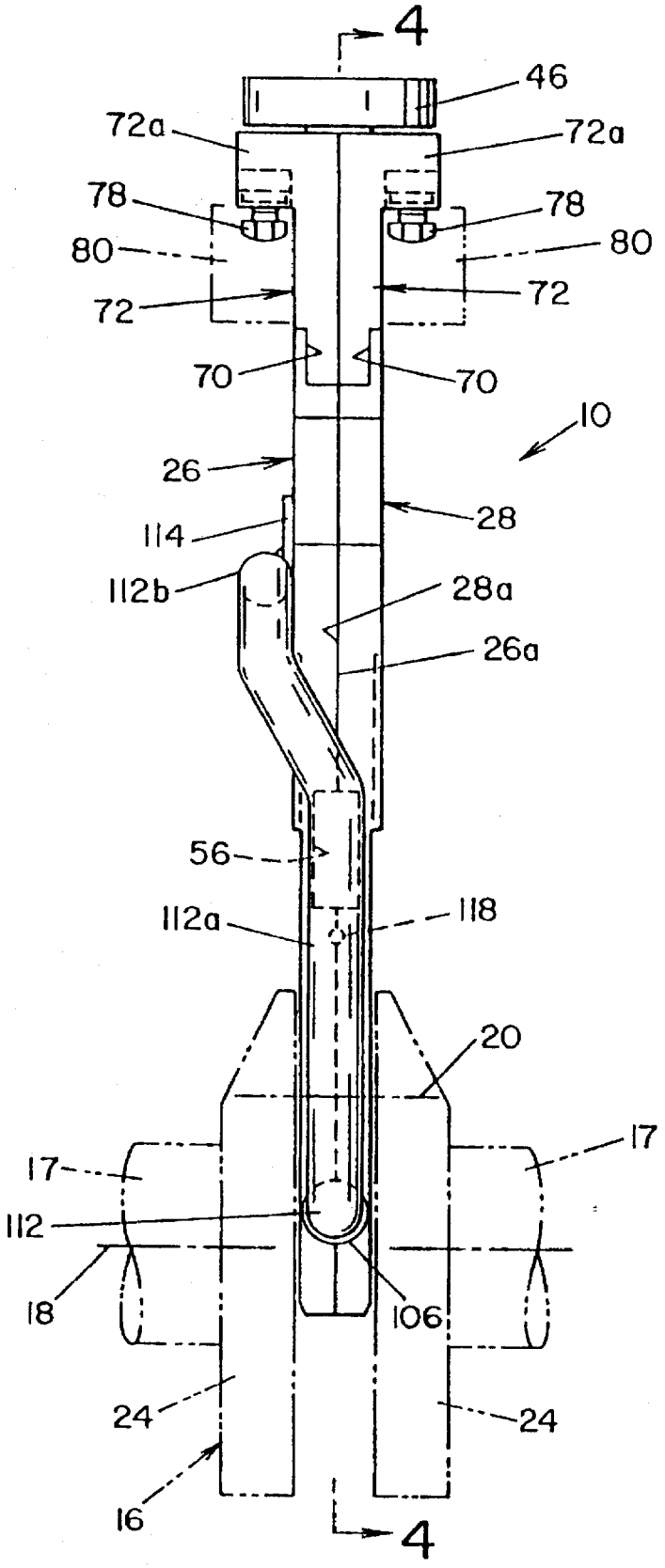
FIG. 3 is an end elevation view of the inductor assembly looking in the direction of line 3—3 in FIG. 2.
Figure 4:
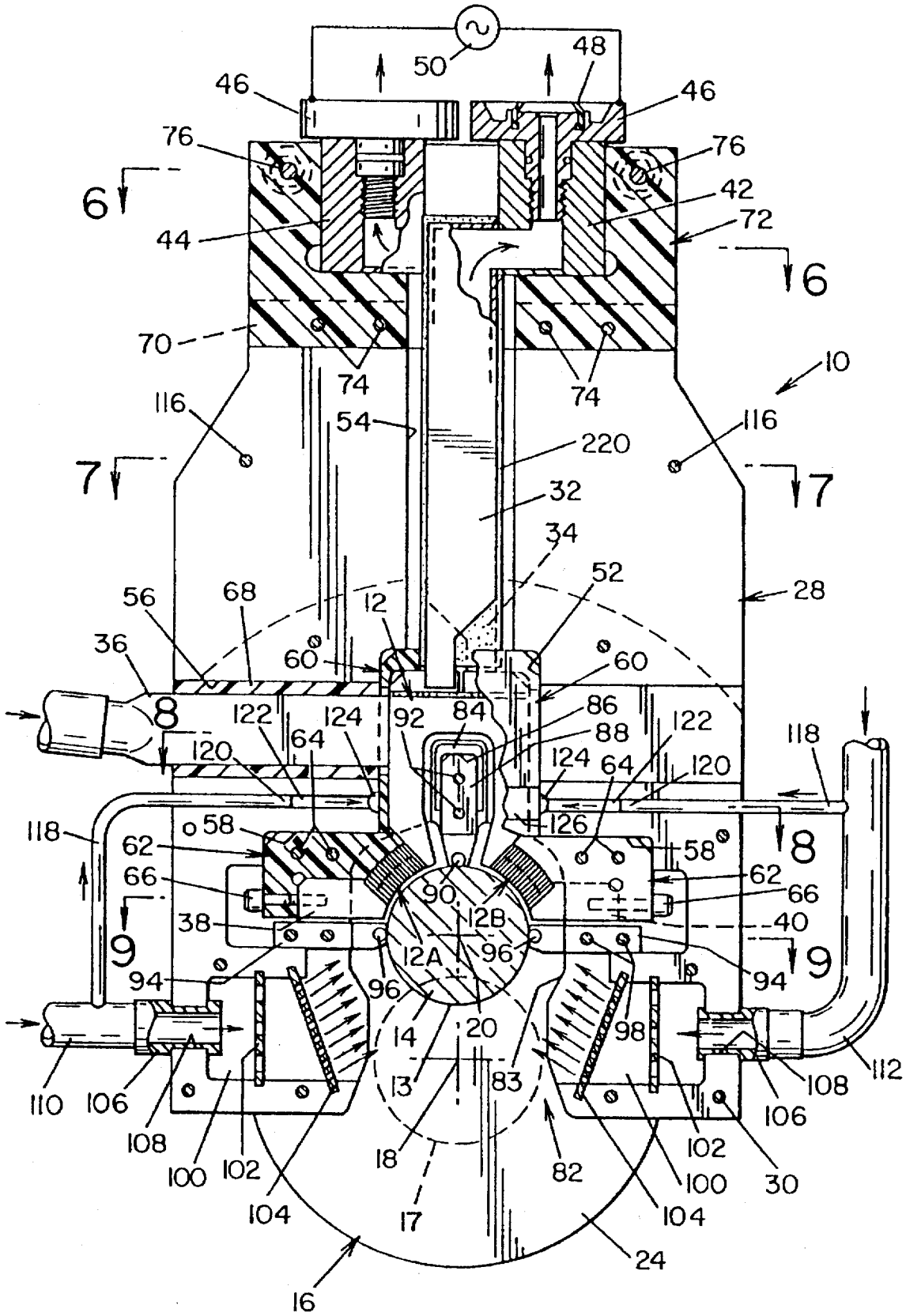
FIG. 4 is a sectional elevation view through the inductor assembly taken along line 4—4 in FIG. 3.
Figure 5:
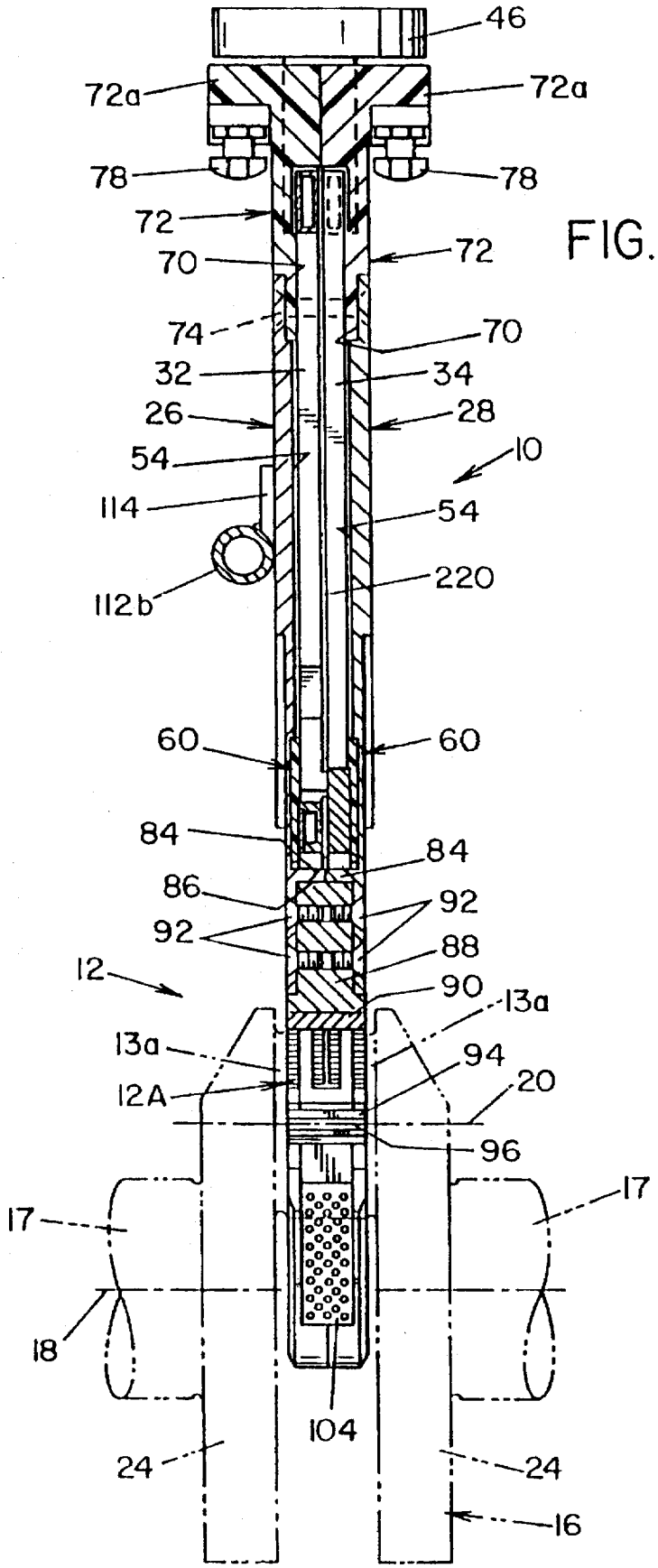
FIG. 5 is a sectional elevation view through the inductor assembly taken along line 5—5 in FIG. 2.
Figure 6:
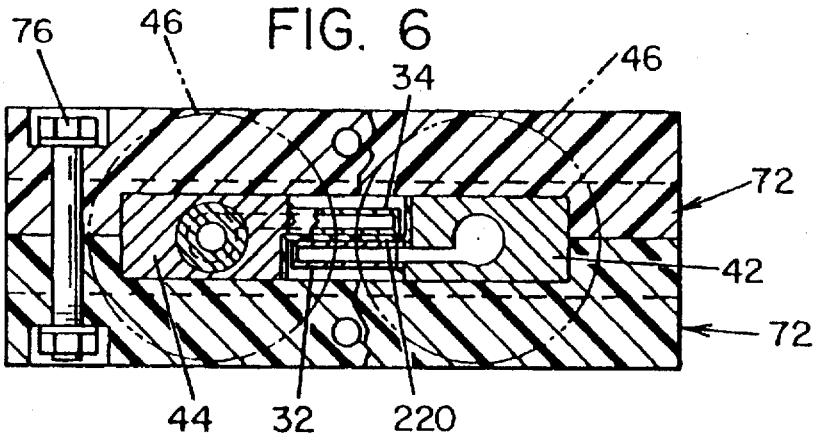
FIG. 6 is a plan view, in section, of the upper end of the inductor assembly taken along line 6—6 in FIG. 4.
Figure 7:
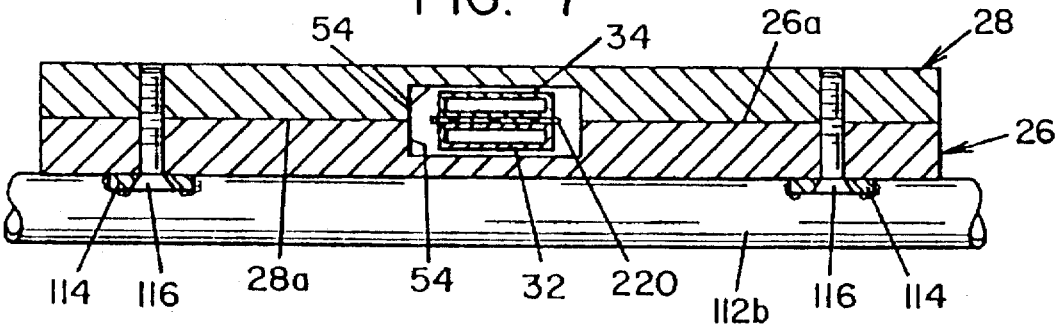
FIG. 7 is a plan view, in section, of the inductor assembly taken along line 7—7 in FIG. 4.
Figure 8:
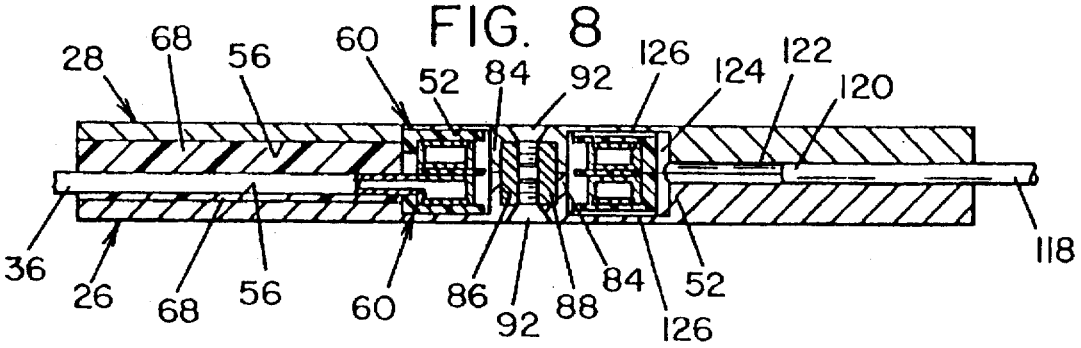
FIG. 8 is a plan view, in section, of the inductor assembly taken along line 8—8 in FIG. 4.
Figure 9:
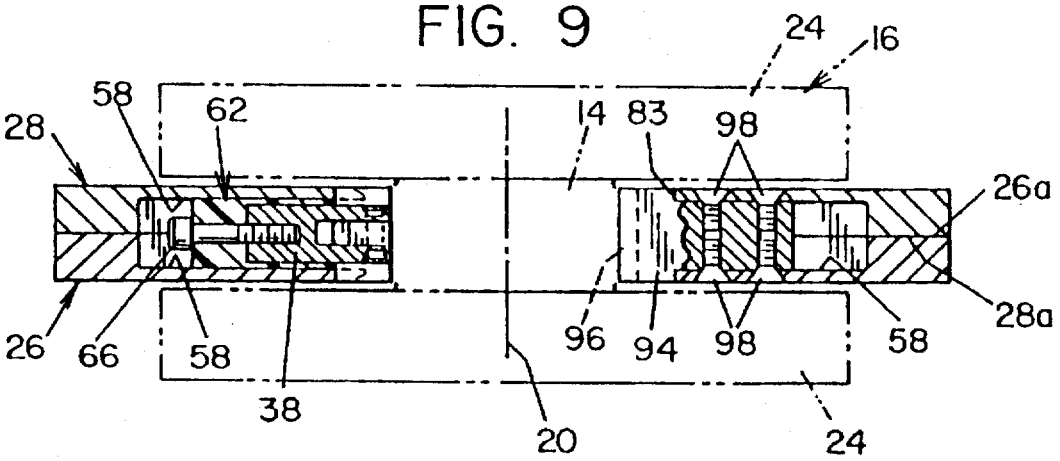
FIG. 9 is a plan view, in section, of the lower portion of the inductor assembly taken along line 9—9 in FIG. 4.

In the preferred embodiment, as best seen in FIGS. 4 and 5, inductor assembly 10 includes quenching liquid chambers 100 provided by milling opposed recesses in the inner sides of side plates 26 and 28 at the lower ends of windows 82 therethrough. Each quenching chamber includes an apertured brass baffle plate 102 and an apertured brass distributing plate 104 which is inclined upwardly relative to axis 20 so as to direct quenching liquid against bearing surface 13. A quenching liquid inlet coupling 106 is provided for each chamber 100 and is captured between side plates 26 and 28 in annular recesses 108 milled on the inner sides thereof. One of the couplings is connected to a quenching inlet supply conduit 110, and the other coupling is connected to a quenching liquid inlet conduit 112. The latter conduit, as best seen in FIGS. 2 and 3, has a leg **112*a* extending upwardly parallel to the outer sides of side plates 26 and 28 and thence outwardly relative to the outer side of side plate 26, and a leg 112*b* extending across the outer side of plate 26 to the same side of the inductor assembly as quench supply conduit 110. Leg 112*b* of conduit 112 is secured adjacent the outer surface of plate 26 by brackets 114 and threaded fasteners 116 which, as shown in FIG. 7, also serve to interconnect the side plates. As will be seen from FIG. 4, each of the supply conduits 110 and 112 is provided with a tap line 118 opening therefrom and having an end 120 received in a corresponding recess 122 milled therefor in the inner surfaces of plates 26 and 28. As best seen in FIGS. 4, 8 and 11, the inner end of each of the recesses 122 opens into a corresponding passage 124 provided in side plates 26 and 28 between the outer sides thereof, and the lower end of each of the locator blocks 60 is provided with a pair of recesses 126 communicating with the corresponding one of the opposite ends of passages 124. Accordingly, during a quenching operation, a portion of the quenching liquid flows through lines 118 and recesses 122 to passages 124 and thence through recesses 126 in locator blocks 60 to the laterally outer sides of flanges 84 which provide pocket 86 for the upper positioning finger. The quenching liquid then flows downwardly along flanges 84 and across shoe 88** of the upper positioning finger so as to cool and thus reduce operating thermal stresses with respect both to the shoe and the support pocket therefor.

As will be appreciated from the description thus far, inductor assembly 10 is positioned between throws 24 of crankshaft 16 as shown in FIGS. 2 and 5 and such positioning, as best seen in FIG. 4, provides for side plates 26 and 28 to properly position active inductor element portions 12A and 12B of the inductor relative to bearing surface 13 of pin bearing 14 through wear inserts 90 and 96 of the upper and laterally opposed positioning fingers. It will be further appreciated that inductor 12 as well as power leads 32 and 34 and coolant supply conduit 36 are rigidly supported between plates 26 and 28 against any displacement relative thereto whereby the desired and critical spacing of the active inductor element portions of the inductor and bearing surface 13 is precisely maintained throughout the induction heating and hardening process. During the latter, crankshaft 16 is rotated about journal axis 18 whereby bearing pin 14 orbits about the latter axis and the inductor assembly rides on bearing surface 13 through the engagement of inserts 90 and 96 therewith. Power is supplied to the active inductor element portions 12A and 12B of the inductor to inductively heat bearing surface 13 thereof to a desired depth, coolant is circulated through the inductor and leads 32 and 34, as will become more apparent hereinafter, and quenching liquid is delivered through conduits 110 and 112 and thence across baffle plates 102 which defuse the liquid and plates 104 which direct the quenching liquid against the inductively heated pin bearing. At the same time, a portion of the quenching liquid flows through tubes 118 as described hereinabove to cool the upper positioning finger.

Figure 12:
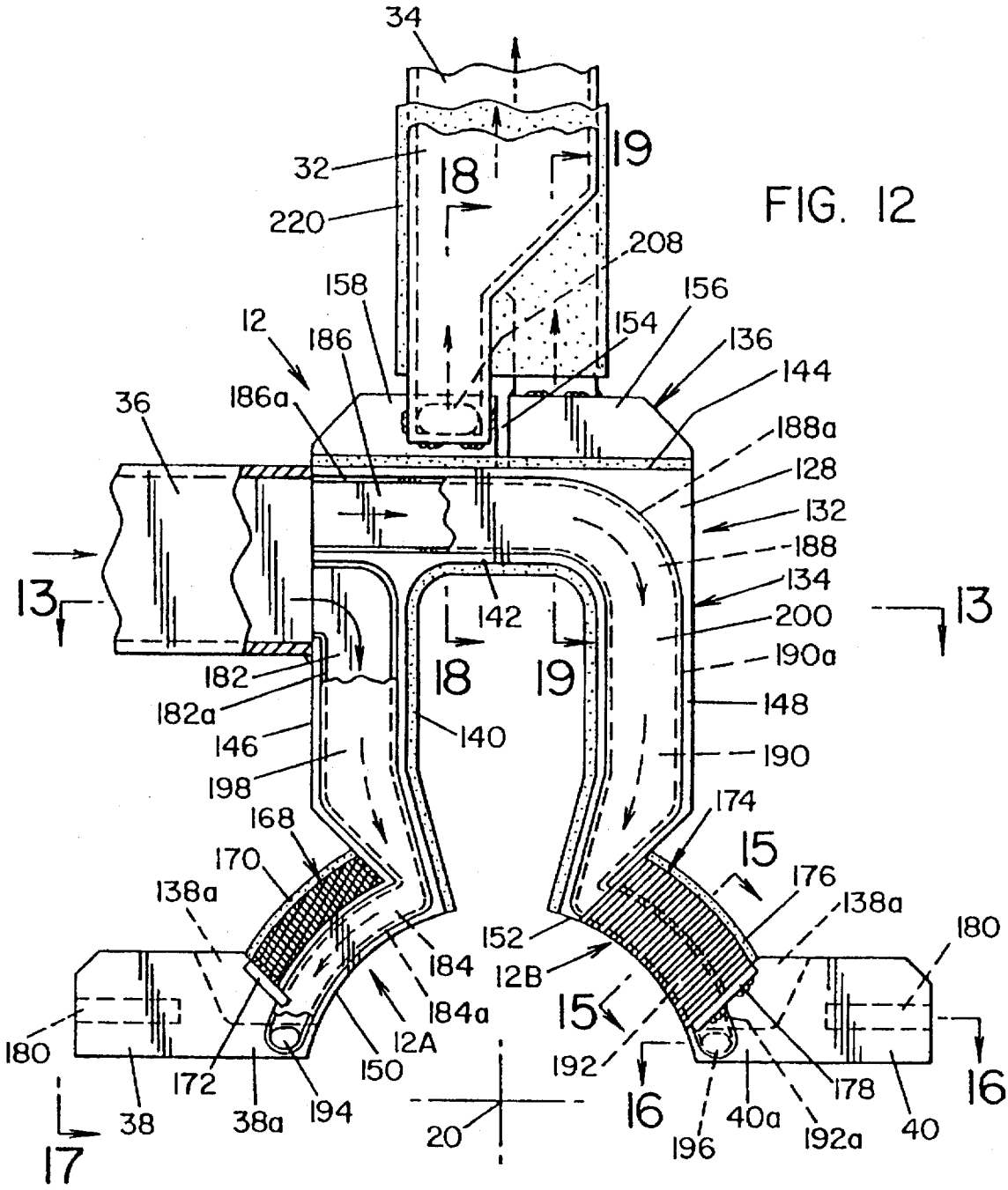
FIG. 12 is an elevation view of one side of the inductor and portions of the electrical leads and coolant conduit connected thereto.
Figure 13:
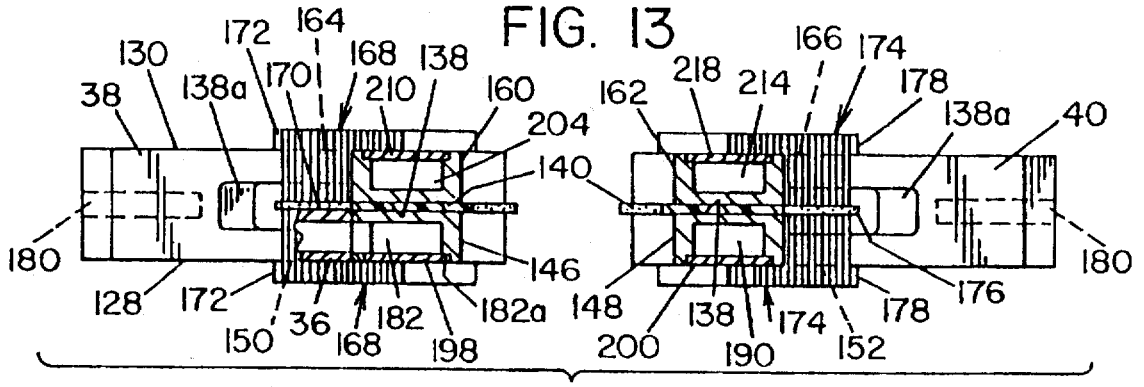
FIG. 13 is a plan view, in section, of the inductor taken along line 13—13 in FIG. 12.

Referring now in particular to FIGS. 10–20 of the drawing, inductor 12 has parallel, axially spaced opposite sides 128 and 130 transverse to axis 20. The inductor is machined as described in greater detail hereinafter from a single block of electrically conductive material to provide an inverted, generally U-shaped yoke portion 132 integral with arcuate active inductor element portions 12A and 12B and inductor mounting lugs 38 and 40 referred to hereinabove. The inductor block is sliced transverse to axis 20 to provide first and second inductor block portions 134 and 136, respectively, separated by a gap 138 which, preferably, is between 0.020 and 0.040 inch wide and receives insulating material 140 which is preferably mica. As best seen in FIG. 12, inductor block portion 134 includes an upper bridging portion 142 having an upper edge 144 and laterally spaced apart legs 146 and 148 extending downwardly from the bridging portion and having lower ends respectively merging with active inductor element portions 12A and 12B. At the juncture between the lower ends of legs 146 and 148 and the corresponding active inductor element portion 12A and 12B the gap between the inductor block portions is axially enlarged as indicated by numeral **138*a*. Gap 138*a* provides for active inductor element portions 12A and 12B to include arcuate inductor legs 150 and 152 which are respectively integral with legs 146 and 148 of inductor block portion 134**.

Figure 21:
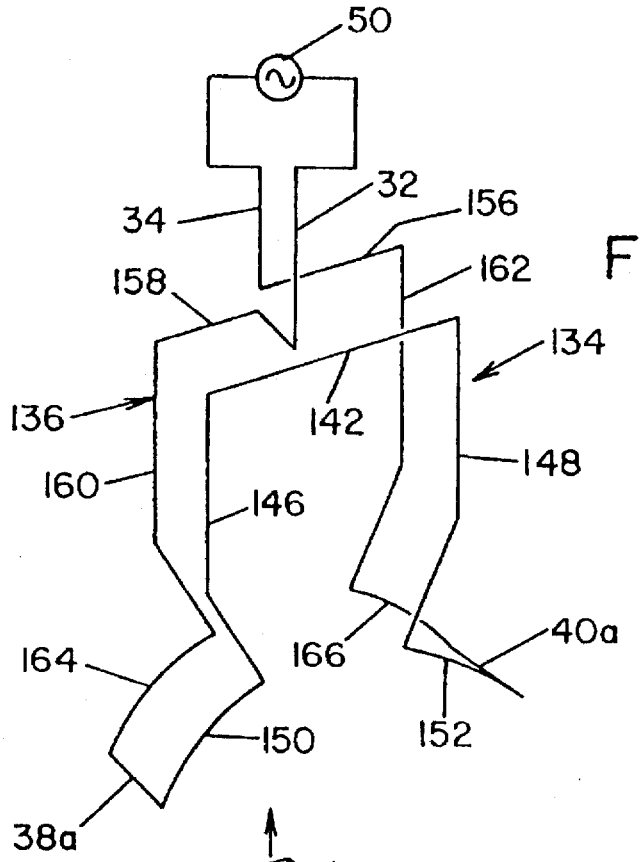
FIG. 21 is a schematic diagram of the inductor coil circuit.

As will be seen from FIG. 14, the upper bridging portion of second inductor block portion 136 is divided by a vertical slot 154 opening into gap 138 to provide terminal ends 156 and 158 for the inductor as set forth more fully hereinafter. Inductor block portion 136 further includes laterally spaced apart legs 160 and 162 extending downwardly from terminal ends 158 and 156, respectively, and gap **138*a* at the juncture of legs 160 and 162 with active inductor element portions 12A and 12B provide for the latter to include arcuate inductor legs 164 and 166 which are respectively integral with legs 160 and 162 of second inductor block portion 136. Inductor legs 150 and 164 of active inductor element portion 12A are integrally joined in area 38*a* of mounting lug 38 beneath gap 138*a* therein and, similarly, inductor legs 152 and 166 of active inductor element portion 12B are integrally joined in area 40*a* of mounting lug 40 beneath 138*a* therein. Thus, as will be appreciated from FIG. 21 in conjunction with the foregoing description, the integrally joined inductor block portions 134 and 136 together with leads 32 and 34 provide a serial path through the inductor for the flow of current therethrough from source 50**.

Each of the arcuate inductor legs 150 and 164 is provided with corresponding U-shaped flux concentrating laminations 168 separated by insulating sheet 170, preferably of mica, and which laminations extend along the corresponding inductor leg between a copper keeper plate 172 brazed to mounting lug 38 and the juncture of the inductor leg with the lower end of the corresponding one of the legs 146 and 160 of inductor block portions 134 and 136. Similarly, each of the inductor legs 152 and 166 is provided with corresponding U-shaped flux concentrating laminations 174 separated by an insulating sheet 176 of mica and extending along the legs between a copper keeper plate 178 brazed to mounting lug 40 and the juncture between the inductor leg and the corresponding one of the legs 148 and 162 of inductor block portions 134 and 136. The laterally outer ends of mounting lugs 38 and 40 are provided with threaded bores 180 for receiving threaded fasteners 66 by which the mounting lugs are secured to support blocks 62 as set forth hereinabove. While insulating sheets 170 and 176 between the flux concentrating laminations are numerically identified separate from insulating sheet 140 between inductor block portions 134 and 136, it will be appreciated that the insulating sheets between the flux concentrating laminations can be integral with sheet 140.

Figure 20:
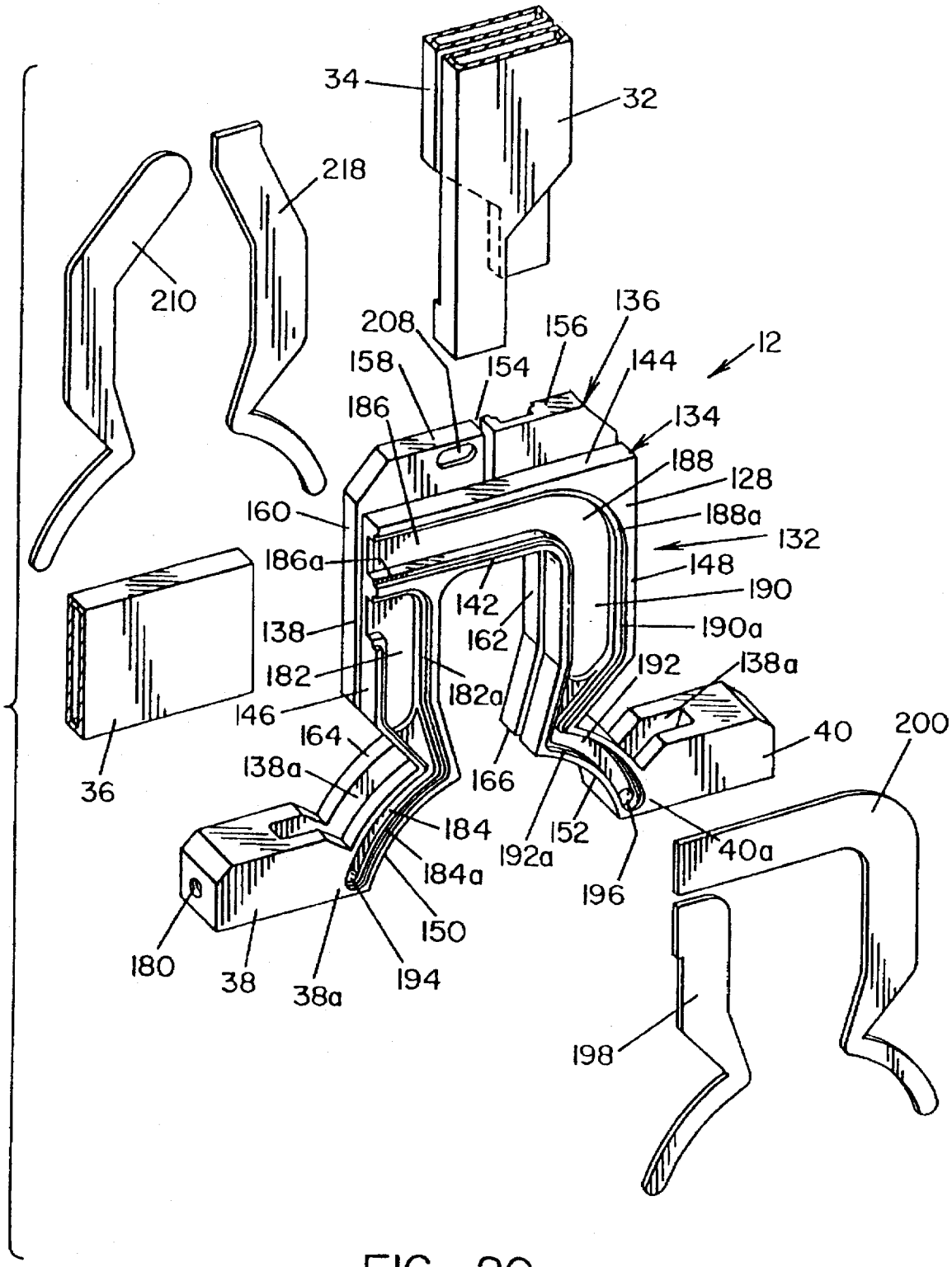
FIG. 20 is an exploded perspective view of the inductor block, covers for the coolant passage recesses therein and the electrical leads and coolant inlet conduit therefor.

Referring again to FIGS. 10–20 of the drawing, outer side 128 of inductor block portion 134 is provided with a first coolant inlet passageway recess having an upper portion 182 opening laterally into the outer side edge of and extending along leg 146 and a lower portion 184 which follows the arcuate contour of inductor leg 150 and terminates in solid portion 38*a* of mounting lug 38. A second coolant inlet passageway recess is provided in outer side 128 and includes an upper portion 186 opening laterally into bridging portion 142 above the entrance end of passageway portion 182 and extending laterally across the bridging portion toward leg 148. The second passageway recess further includes a curved portion 188 connecting portion 186 with a portion 190 extending downwardly along leg 148, and a lower portion 192 which follows the arcuate contour of inductor leg 152 and terminates in solid portion 40*a* of mounting lug 40. Bores 194 and 196 are provided through mounting lug portions 38*a* and 40*a*, respectively, for the purpose which will become apparent hereinafter. As best seen in FIG. 20, first recess portions 182 and 184 have corresponding ledges 182*a* and 184*a* extending along the edges thereof to receive a correspondingly contoured copper cover plate 198 which is brazed to the inductor block portion, whereby the recesses and cover plate provide a first inlet passageway. Similarly, second recess portions 186, 188, 190 and 192 are provided with corresponding ledges 186*a*, 188*a*, 190*a* and 192*a* extending along the edges thereof which receive a correspondingly contoured copper cover plate 200 which is brazed to the inductor block, whereby the second recess portions and cover plate provide a second coolant inlet passageway. Coolant inlet conduit 36 is brazed to the side edge of inductor block portion 134 to supply coolant to the inlet ends of both the first and second inlet passageways.

Figure 14:
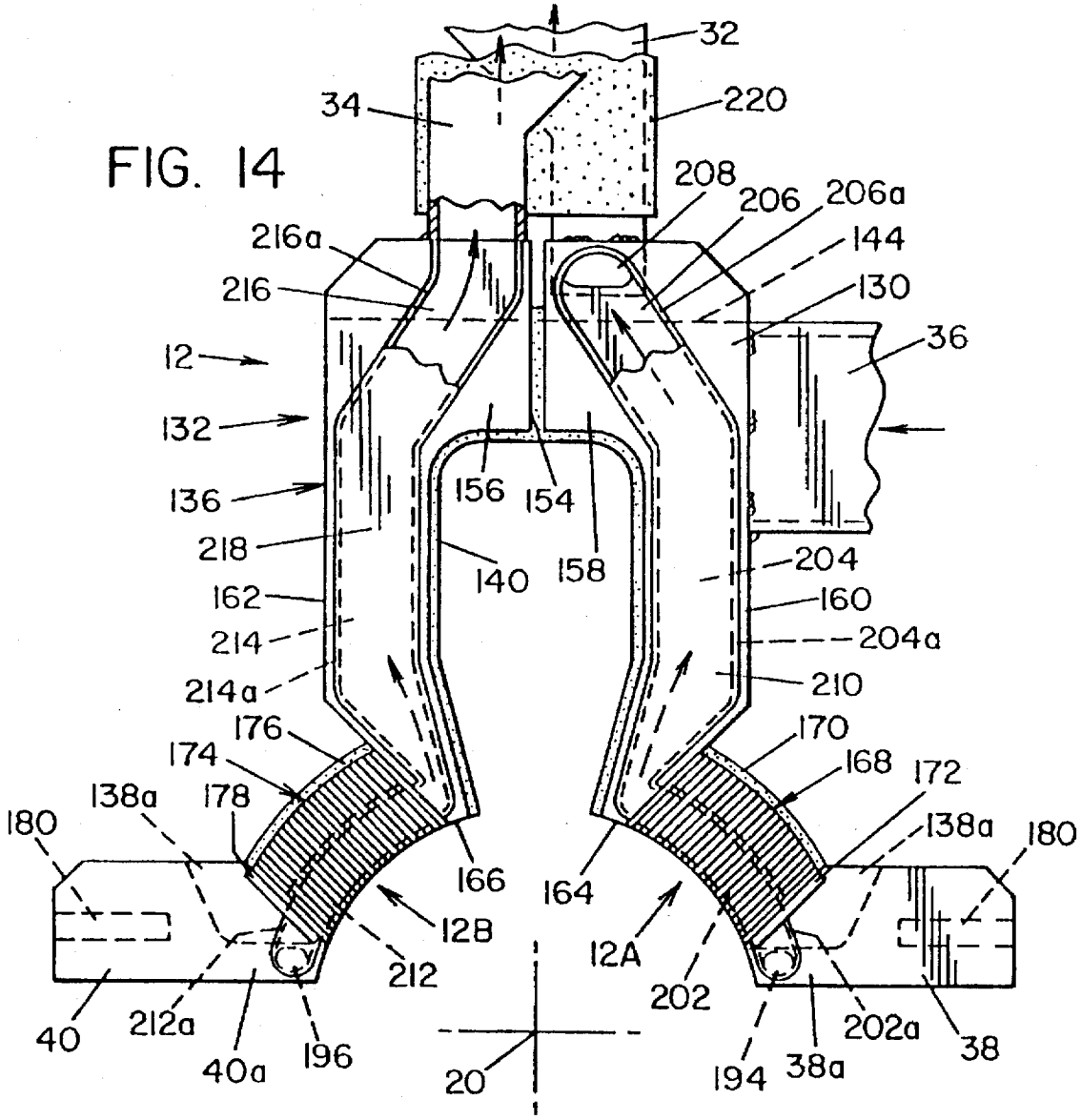
FIG. 14 is an elevation view of the side of the inductor opposite the side shown in FIG. 12.
Figure 15:
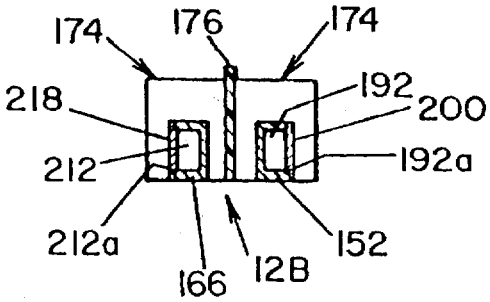
FIG. 15 is a cross-sectional view through active inductor elements of the inductor taken along line 15—15 in FIG. 12.
Figure 16:
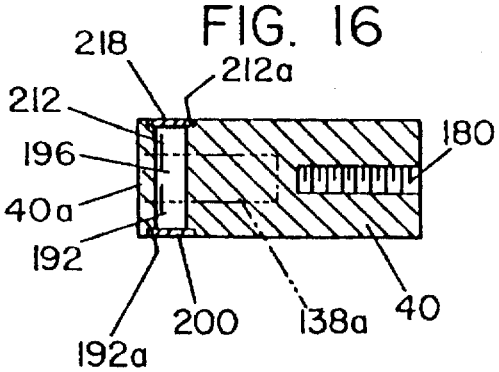
FIG. 16 is a plan view, in section, through a mounting lug of the inductor taken along line 16—16 in FIG. 12.
Figure 17:
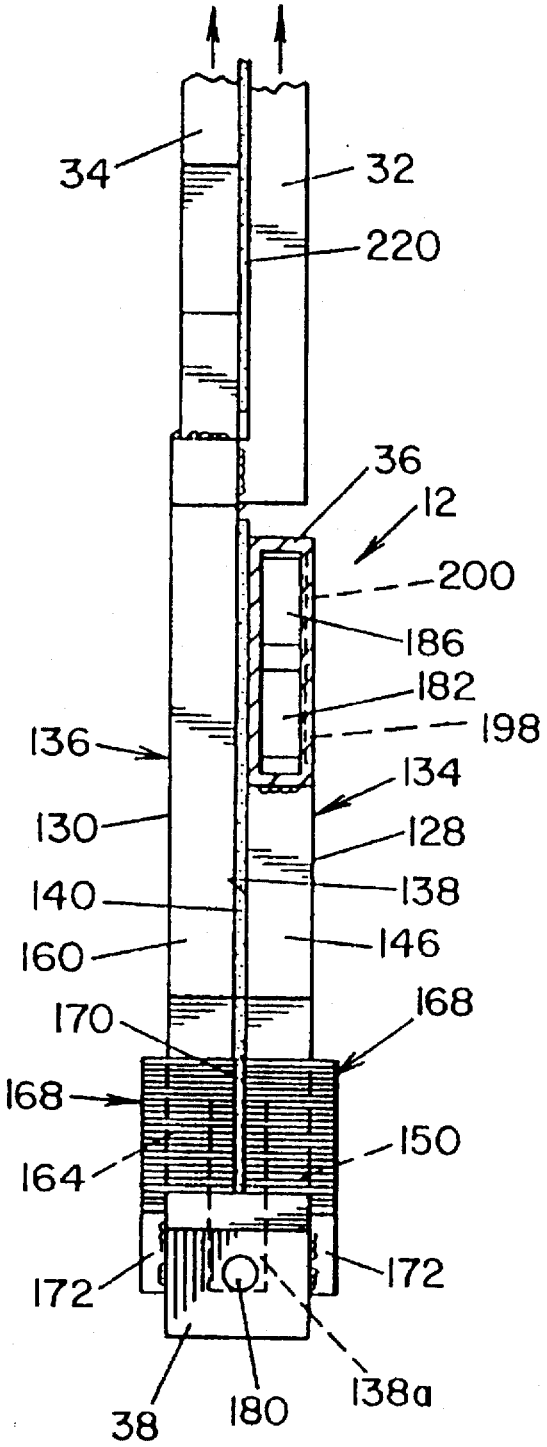
FIG. 17 is an elevation view of the inductor as seen along line 17—17 in FIG. 12.
Figure 18:
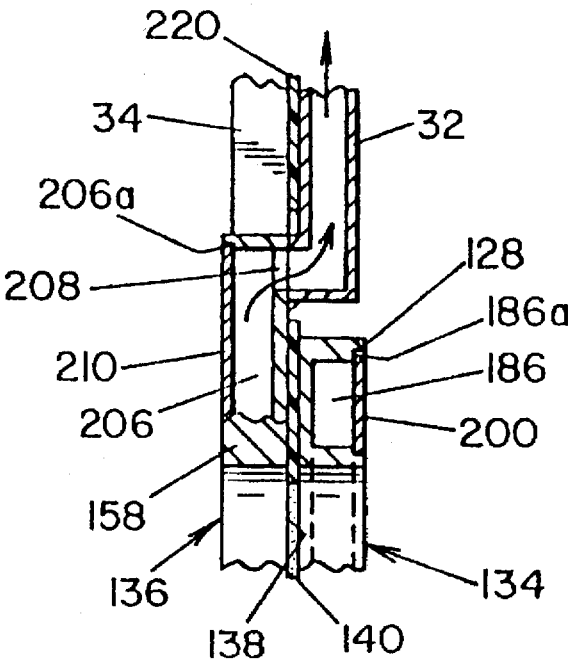
FIG. 18 is a sectional elevation view through the inductor taken along line 18—18 in FIG. 12.
Figure 19:
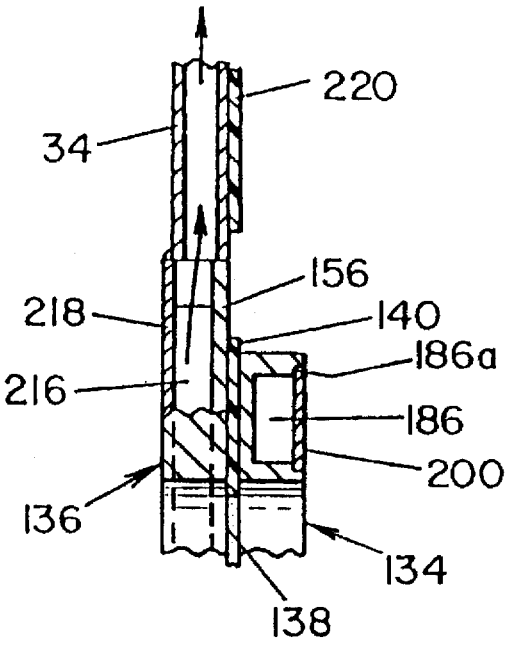
FIG. 19 is a sectional elevation view through the inductor taken along line 19—19 in FIG. 12.

As will be seen from FIG. 14, outer side 130 of second inductor block portion 136 is provided with a first coolant outlet passageway recess including an arcuate lower recess portion 202 following the contour of inductor leg 164. Recess portion 202 has a lower end in solid portion 38*a* of mounting lug 38 and into which bore 194 opens so as to communicate the lower end of recess 202 with recess 184 in the opposite side of the mounting lug. The first outlet passageway recess further includes a portion 204 extending upwardly from portion 202 along leg 160, and an upper portion 206 which angles laterally inwardly across terminal end 158 of the inductor block portion. The uppermost end of recess portion 206 is in communication with the opposite side of the terminal block portion through an opening 208, and the lower end of tubular inductor lead 32 is brazed to the latter face of terminal end 158 in communication with opening 208. Each of the recess portions 202, 204 and 206 includes corresponding ledges 202*a*, 204*a* and 206*a* extending along the edges thereof to receive a correspondingly contoured cover 210, whereby the recess portions and cover provide a first coolant outlet passageway in communication with inductor lead 32. Outer side 130 of second inductor block 136 is further provided with a second outlet passageway recess including a lower portion 212 which follows the contour of inductor leg 166. Recess portion 212 has a lower end in solid portion 40*a* of mounting lug 40 and in communication with recess portion 192 on the opposite side thereof through bore 196. The second outlet passageway recess further includes a portion 214 extending upwardly from portion 212 along leg 162, and an upper portion 216 angling laterally inwardly across terminal end 156 of the second inductor block portion and opening through the upper edge thereof. The lower end of inductor lead 34 is brazed to the top edge of terminal end 156 in communication with recess portion 216. Recess portions 212, 214, and 216 include corresponding ledges 212*a*, 214*a* and 216*a* extending along the edges thereof which receive a correspondingly contoured cover 218, whereby the recess portions and cover provide a second coolant outlet passage in communication with inductor lead 34.

Figure 22:
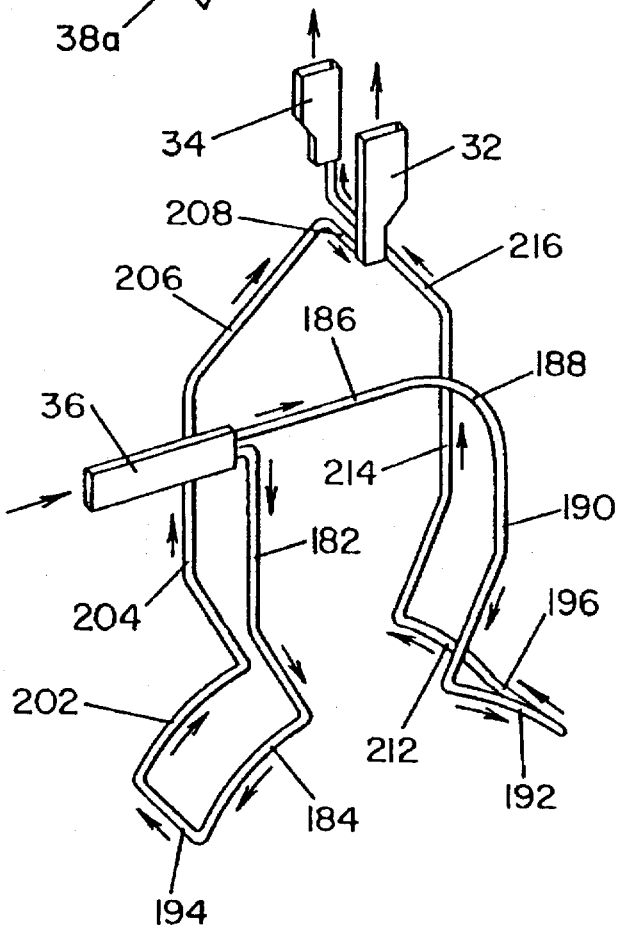
FIG. 22 is a schematic illustration of the coolant flow paths through the inductor.

As shown schematically in FIG. 22, wherein the flow passages are designated by the numbers representing the recess portions in the foregoing description, first and second coolant flow paths are provided through the inductor block from coolant inlet conduit 36 to and through inductor leads 32 and 34. In this respect, the first flow path is through first inlet passages 182 and 184, bore 194, first outlet passages 202, 204 and 206, opening 208 and the lower end of inductor lead 32. The second flow path is through second inlet passages 186, 188, 190 and 192, bore 196, second outlet passages 212, 214 and 216 and the lower end of inductor lead 34. At this point, it will be noted that inductor leads 32 and 34 are rectangular in cross-section and that the lower ends thereof are necked laterally inwardly in opposite directions for connection to the corresponding one of the terminal ends 156 and 158 of inductor block portion 136. Further, it will be noted that the connection of the lower end of lead 32 to the inner face of terminal end 158 and the connection of the lower end of lead 34 to the upper edge of terminal end 156 provides for the axially outer sides of leads 32 and 34 to be respectively generally coplanar with axially opposite sides 128 and 130 of the inductor block. Furthermore, the axially inner sides of leads 32 and 34 are closely spaced apart, preferably between about 0.020 and 0.040 inch, and a sheet 220 of suitable insulating material such as Teflon is provided therebetween.

While not shown, leads 32 and 34 together with insulating sheet 220 therebetween are preferably wrapped between the opposite ends thereof with a tape of insulating material such as fiberglass. As will be appreciated from the earlier description herein of the inductor assembly, the upper ends of inductor leads 32 and 34 respectively communicate with coolant passageways through contact flange receivers 42 and 44 and the corresponding apertured contact flange 46, whereby coolant flowing through the first and second coolant paths respectively exits the inductor through receiver blocks 42 and 44 and the corresponding contact flange. By providing two coolant passageways through the inductor in the foregoing manner, cooling of the inductor is optimized. Further in this respect, configuring the coolant passageways as shown in FIGS. 12 and 14 so as to optimize the width thereof relative to the faces of the inductor block portions and to minimize abrupt changes in direction and size by curving or angling adjacent portions thereof and tapering the sides of the recesses, turbulence in the flow of coolant through the passageways is minimized and the surface areas of the passages exposed to the cooling liquid is optimized, thus to enhance thermal transfer to the coolant and thus obtain optimum cooling efficiency. Further, there are no brazed joints between adjacent passageway portions, thus promoting structural integrity and eliminating thermal stress encountered with fabricated tubular inductors. Moreover, the close coupling of the inductor leads 32 and 34 as described above promotes concentrating current flow therethrough on the axially inner sides thereof, thus to minimize heating of the side plates of the inductor assembly and further promote cooling efficiency with respect to the inductor assembly.

Figure 23A:
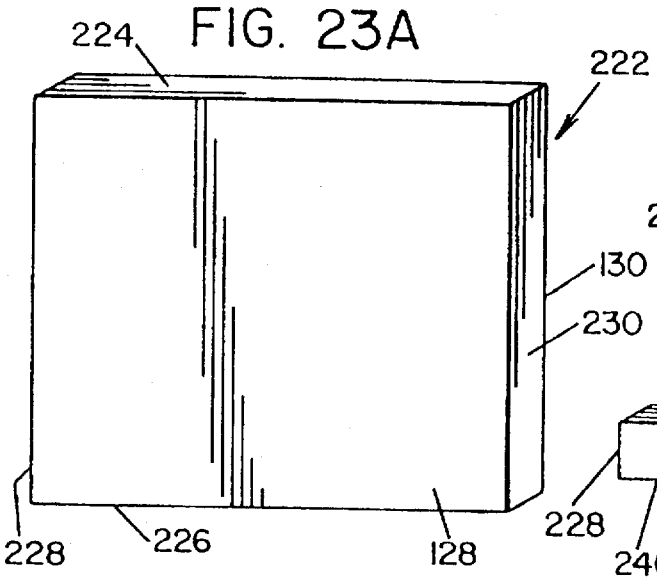
FIGS. 23A–23K illustrate the sequence of steps in constructing the inductor and connecting the electrical leads and coolant inlet conduit thereto.
Figure 23B:
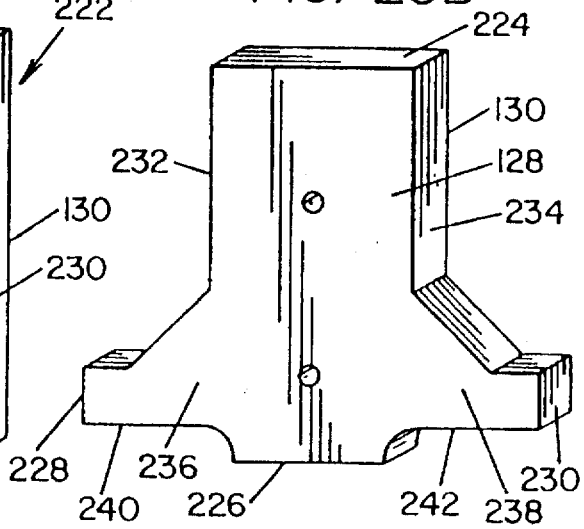
Figure 23C:
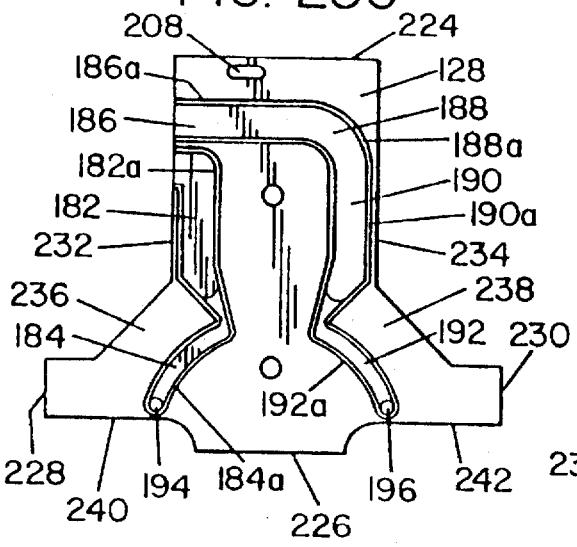
Figure 23D:
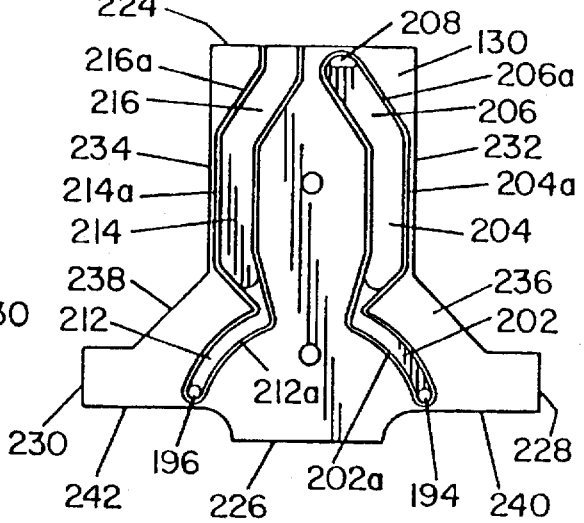

Referring now to FIGS. 23A–23K, inductor 12 is machined from a single block 222 of electrically conductive material, preferably copper, using CNC machining techniques. The inductor is machined as described in detail hereinafter and, in conjunction with such description, the various parts of the inductor are identified by numerals corresponding to those used in the structural description of the inductor herein. In its initial form, block 222 has planar, parallel opposite faces corresponding to sides 128 and 130 of the inductor in its final form, and has top and bottom edges 224 and 226, respectively, and opposite side edges 228 and 230 spaced apart a distance corresponding to the major width of the finished inductor as defined by the outermost ends of mounting lugs 38 and 40. As seen in FIG. 23B, block 222 is initially milled to provide a pre-machined block having an inverted generally T-shaped configuration which includes a central portion between opposite side edges 232 and 234 which are spaced apart a distance corresponding to the final width of the yoke portion of the inductor. The pre-machined block further includes lower portions 236 and 238 which extend laterally outwardly of the central portion. Portions 236 and 238 provide a preliminary configuration for the lower portion of the inductor, including active inductor element portions 12A and 12B and mounting lugs 38 and 40, and have bottom edges 240 and 242 corresponding to the bottom edges of mounting lugs 38 and 40, respectively. The central portion of side 128 of the pre-machined block is then milled as shown in FIG. 23C to provide first coolant inlet passageway recesses 182 and 184 and the corresponding cover ledges **182*a* and 184*a* and to provide second coolant inlet passageway recesses 186, 188, 190 and 192 and the corresponding cover ledges 186*a*, 188*a*, 190*a* and 192*a*. The block is then drilled to provide passages 194 and 196 at the lower ends of recesses 184 and 192, and is machined to provide opening 208 in the upper end thereof. As shown in FIG. 23D, the pre-machined block is then turned over and the central portion of side 130 thereof is milled to provide first coolant outlet passageway recesses 202, 204 and 206 and the corresponding cover ledges 202*a*, 204*a* and 206*a*, and to provide second outlet passageway recesses 212, 214 and 216 and the corresponding cover ledges 212*a*, 214*a* and 216*a*. At this point, it will be noted that it is only necessary to machine opening 208 into side 128 of the block to a depth sufficient for the opening to communicate with the bottom of outlet recess 206**.

Figure 23E:
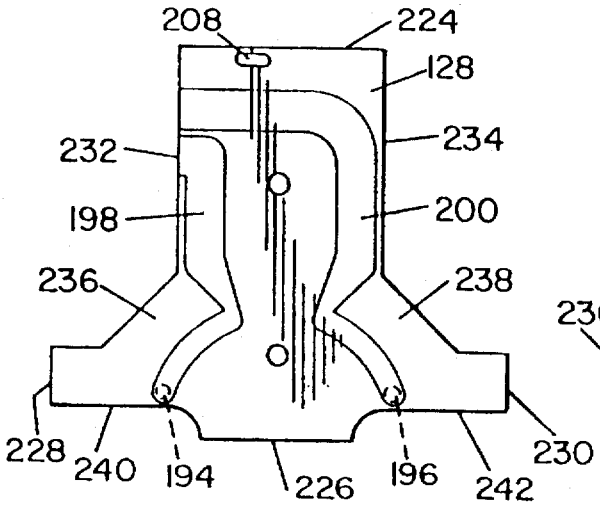
Figure 23F:
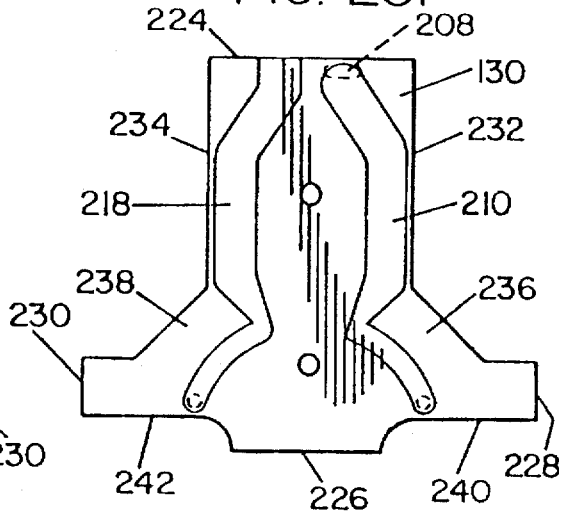
Figure 23G:
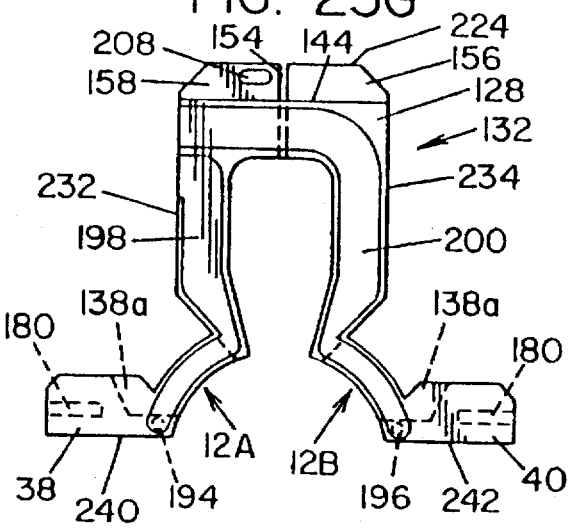
Figure 23H:
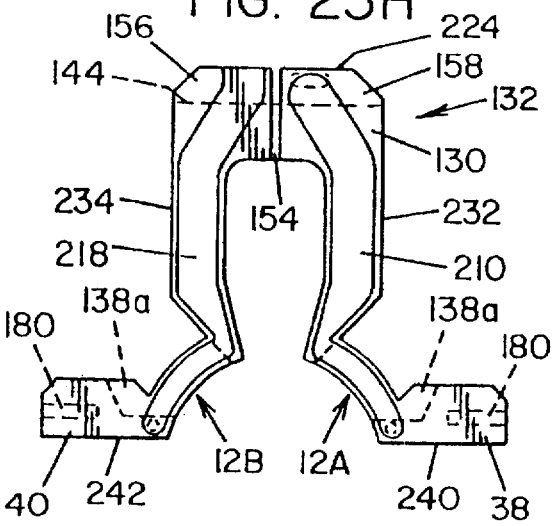
Figure 23I:
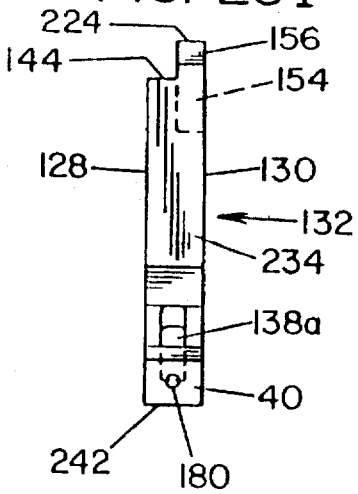
Figure 23J:
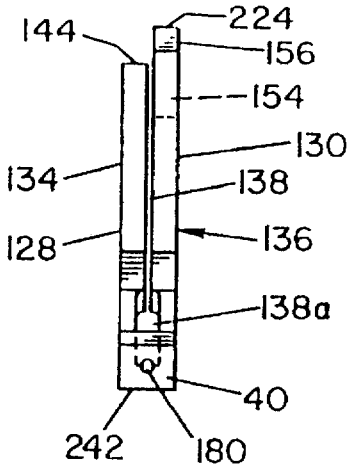
Figure 23K:
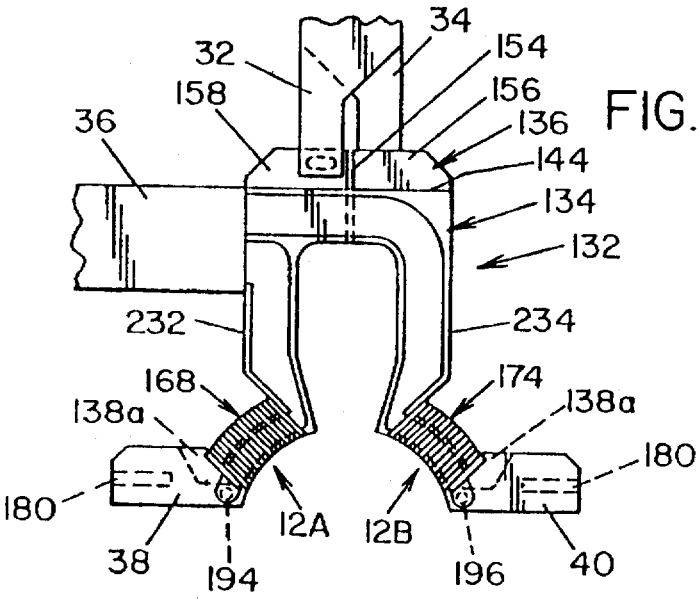

As will be appreciated from FIGS. 23E and 23F, inlet passageway recess covers 198 and 200 are then positioned on the corresponding recess ledges and are brazed to side 128 of the block, and outlet passageway recess covers 210 and 218 are placed on the corresponding recess ledges and brazed to side 130 of the block. Following brazing of the coolant passageway recess covers in place on the opposite sides of the pre-machined block, the latter is machined by milling to the inverted U-shaped configuration shown in FIGS. 23G and 23H which provides the inductor yoke portion 132, the precise arcuate configuration of active inductor element portions 12A and 12B and mounting lugs 38 and 40. As shown in FIGS. 23G, 23H and 23I, this machining stage further includes milling the gaps **138*a* to form the individual inductor legs of active inductor element portions 12A and 12B, milling the upper end of the yoke portion inwardly of side 128 to provide upper edge 144 of inductor block portion 134, sawing inwardly from side 130 of the block to provide slot 154 which divides the upper end of inductor block portion 136 into terminal ends 156 and 158, and boring and tapping the outer ends of mounting lugs 38 and 40 to provide threaded openings 180 therein. Finally, as will be seen from FIG. 23J, the inductor block is sawed between and parallel to sides 128 and 130 from upper edge 144 down to gaps 138*a* to provide gap 138 which divides the block into inductor block portions 134 and 136 integrally joined at the lower ends thereof by the mounting lug portions below gaps 138*a*. The inductor is then completed as shown in FIG. 23K by mounting flux concentrator sections 168 and 174 on the individual inductor legs providing active inductor element portions 12A and 12B, brazing coolant inlet conduit 36 to the side of inductor block portion 134, and brazing inductor leads 32 and 34 respectively to the inner face of terminal end 158 of inductor block portion 136 and to the top edge of terminal end 156** of the latter.

As previously mentioned herein, the use of CNC machining techniques not only enables obtaining dimensional precision with respect to the inductor block and support plates, but also enables obtaining such precision repeatedly from one inductor and inductor assembly to the next so as to promote uniformity from the standpoint of structure and consistency with respect to efficiency in operation and thus with respect to obtaining the desired hardening of crankshaft bearing surfaces from one installation to another. In conjunction with the inductor machining procedure described above, it is to be noted that the milling of the coolant passage recesses and the brazing of the covers thereacross is preferably achieved with the copper block in the pre-machined contour thereof as described hereinabove. In this respect, the copper block is still solid and of substantial size which gives mechanical stability thereto during the milling and brazing operations. If the inductor block were machined to the final peripheral configuration thereof shown in FIGS. 23G and 23H, before milling the coolant passageway recesses therein and brazing the covers thereacross, the loss of support resulting from the removal of a substantial amount of material from the pre-machined shape could well result in distortion of the block during the milling and/or brazing operation.

Figure 24:
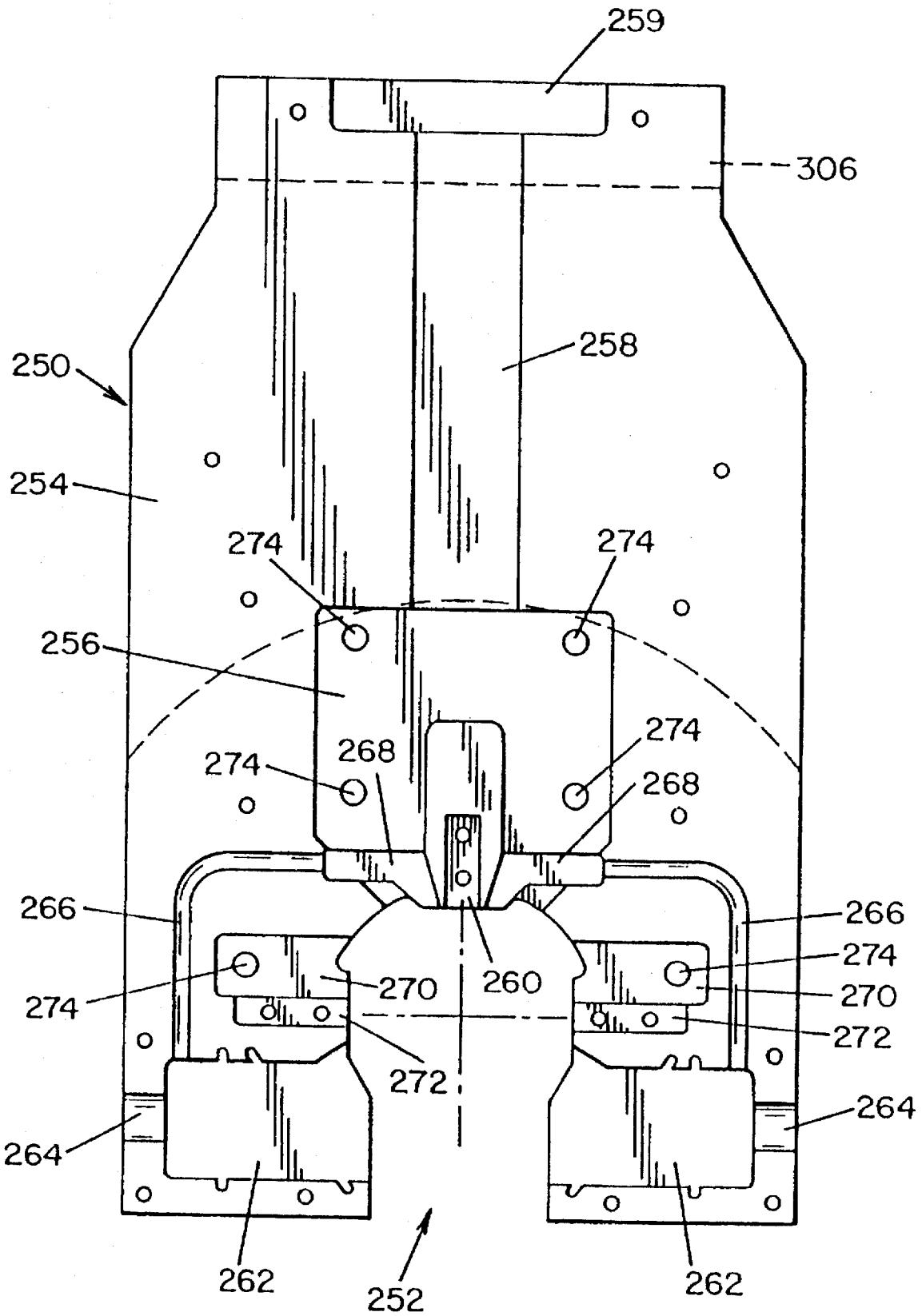
FIG. 24 is an elevation view of the inner side of a modified side plate of another embodiment of an inductor assembly according to the invention.
Figure 25:
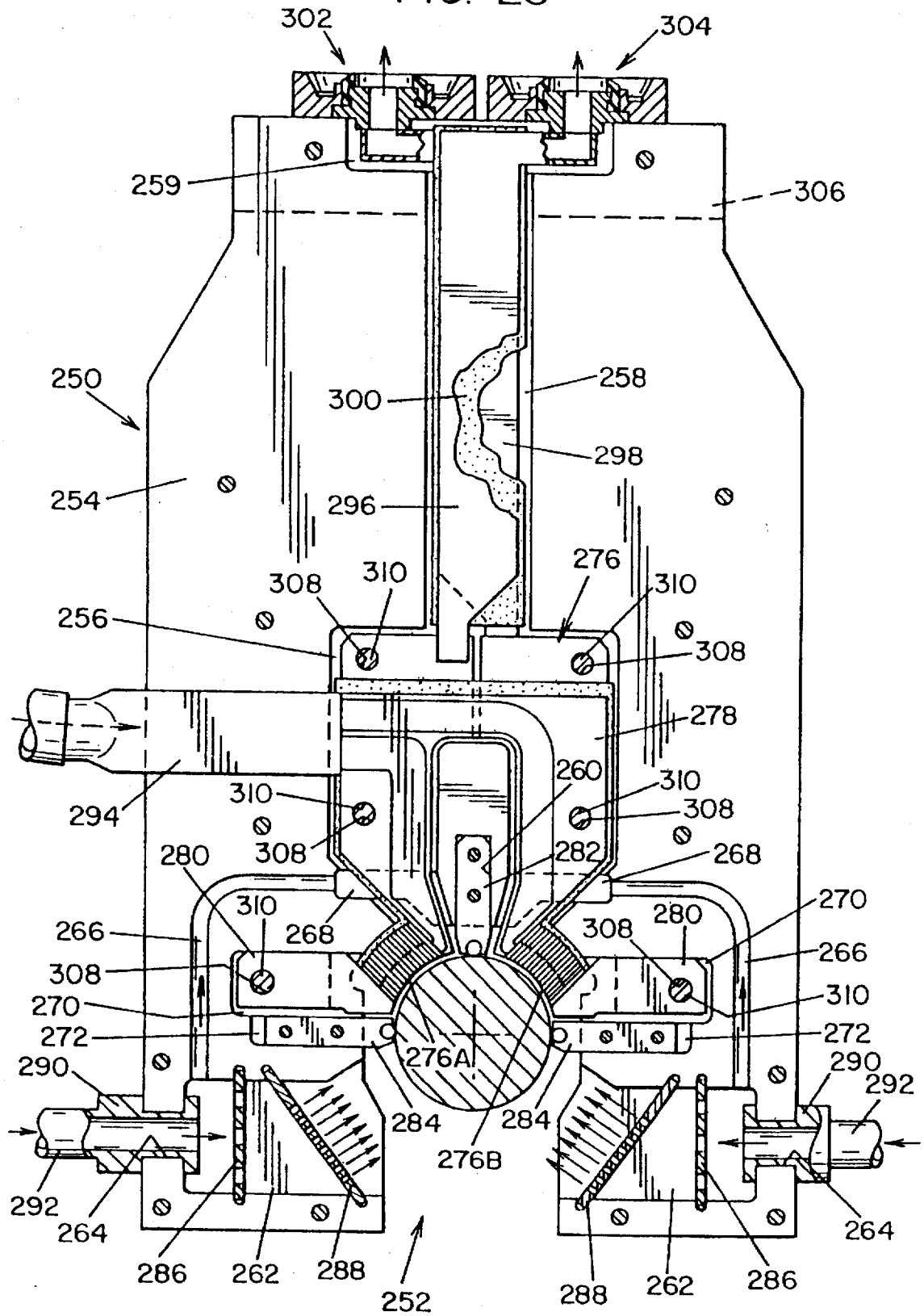
FIG. 25 is an elevation view, partially in section, similar to FIG. 24 and showing the inductor, positioning shoes, coolant and quenching liquid components in assembled relationship with the side plate.

Another embodiment of a side plate construction and an inductor assembly according to the invention is shown in part and will be understood from FIGS. 24 and 25 of the drawing. The side plate and inductor assembly of this embodiment is similar in many respects to that described hereinabove in conjunction with FIGS. 1–10 of the drawing, and the latter Figures will be referred to in connection with certain features of the present embodiment. Referring now to FIGS. 24 and 25, the inductor assembly according to this embodiment includes a pair of side plates 250 basically similar in exterior contour to side plates 26 and 28 shown in FIGS. 1–5 and one of which side plates 250 is shown in FIGS. 24 and 25. The structure of the interior sides of plates 250 is substantially identical, whereby the following description is with regard to both of the side plates. The two side plates are constructed from G-10 insulating material and have a generally U-shaped window 252 at the lower end thereof and inner sides including planar inner surfaces 254 disposed in facial engagement with one another when the side plates are in assembled relationship. The inner sides of the side plates are machined using CNC techniques to provide opposed aligned pairs of recesses 256 and opposed aligned pairs of recesses 258 which, as will become more apparent hereinafter, cooperatively clamping engage the inductor body and inductor leads respectively therebetween. The upper ends of recesses 258 open into laterally extending recesses 259 which in turn open through the top edge of the side plates for the purpose which will become apparent hereinafter. The inner sides are also machined to provide opposed aligned pairs of recesses 260 which clampingly engage an upper positioning shoe therebetween, and two opposed pairs of quenching chamber recesses 262 which, when the sides plates are assembled, cooperatively provide quenching liquid chambers opening laterally inwardly from the opposite sides of window 252. Each chamber recess 262 further includes a recess 264 opening laterally outwardly of the chamber recess and which, when the side plates are assembled, clampingly engage quenching liquid inlet couplings therebetween. In this embodiment, the inner sides of each of the two side plates further include recesses 266 extending from the corresponding one of the quenching chamber recesses 262 and terminating in a distribution recess 268 opening into the upper end of window 252 adjacent laterally opposite sides of positioning shoe recess 260. When the side plates are assembled, opposed pairs of the recesses 266 and distribution recesses 268 cooperatively define a passageway by which a portion of the quenching liquid in the corresponding quenching liquid chamber is directed to the corresponding side of the positioning shoe recess in a manner similar to that provided by tap lines 118 in the embodiment illustrated in FIGS. 1–4 and 8 of the drawing.

The inner sides of side plates 250 are further machined to provide two opposed pairs of recesses 270 opening laterally inwardly of the side plates from window 252, and two pairs of opposed recesses 272 opening laterally inwardly of the side plates from window 252 beneath recesses 270. The opposed pairs of recesses 270 clampingly engage mounting lugs of the inductor therebetween when the side plates are assembled, and opposed pairs of recesses 272 clampingly engage a corresponding lower positioning shoe therebetween when the side plates are assembled. In this embodiment, and for the reason which will be set forth more fully hereinafter, each of the side plates 250 is provided with a plurality of bores 274 therethrough, four of which bores are located in and generally adjacent the corners of recess 256, and the other two of which bores are located adjacent the laterally outer ends of recesses 270.

Referring now to FIG. 25, the inductor 276 of the inductor assembly of this embodiment is structurally similar to inductor 12 illustrated and described herein whereby, with the exceptions to be pointed out below, reference can be had to FIGS. 1–23 and the corresponding description for details regarding the inductor. As will be appreciated from FIG. 25, the inverted U-shaped yoke portion 278 of inductor 276 is received between opposed recesses 256 of side plates 250 with the arcuate active inductor element portions 276A and 276B inwardly adjacent the edge of window 252. Mounting lugs 280 of the inductor are received between the corresponding opposed pairs of recesses 270 in the side plates. Upper positioning shoe 282 is received in the pocket defined by opposed recesses 260, and lower positioning shoes 284 are received between the corresponding pairs of opposed recesses 272 in the side plates. As in the earlier embodiment, baffle plates 286 and distributing plates 288 are captured between the corresponding pair of opposed quench chamber recesses 262, and quenching liquid inlet couplings 290 are captured between the corresponding pair of opposed recesses 264. Each of the couplings 290 is connected to a corresponding quenching liquid inlet line 292.

Inductor 276 further includes a coolant inlet conduit 294 corresponding to inlet conduit 36 in the earlier embodiment, whereby it will be appreciated that the conduit 294 opens into the inlet ends of coolant passageways through one of the inductor block portions of inductor 276. Likewise, as will be appreciated from FIGS. 8 and 10 of the drawing, conduit 294 is offset relative to the plane between the inner surfaces of side plates 250 whereby, as will be appreciated from FIG. 25, conduit 294 overlies inner surface 254 of the side plate shown and is clampingly engaged thereagainst by a recess in the second side plate receiving conduit 294. Finally, inductor 276 includes inductor leads 296 and 298 respectively corresponding to leads 32 and 34 in the earlier embodiment and which leads are provided with insulation 300 therebetween and are engaged between opposed recesses 258 in the side plates. The upper ends of leads 296 and 298 are provided with contact flange assemblies 302 and 304, respectively, the inner portions of which are clampingly received between opposed recesses 259 in side plates 250.

As will be appreciated from FIG. 25 and the foregoing description, the production of side plates 250 from G-10 insulating material advantageously provides for yoke portion 278 of inductor 276, as well as mounting lugs 280, coolant conduit 294 and upper ends 302 and 304 of leads 296 and 298 of the inductor, to be supported in the recesses therefor between the side plates without the need for corresponding clamping blocks of insulating material as in the embodiment illustrated in FIGS. 1–10. Furthermore in this respect, the use of insulating material for the side plates enables the laterally outwardly extending mounting legs 72*a* shown in FIG. 5 of the drawing to be integral with the upper ends of the side plates and to extend laterally outwardly from the outer sides thereof as is represented by broken line 306 in FIG. 25.

Inductor 276 differs structurally from inductor 12 of the earlier embodiment in that the laterally outer sides of the copper block from which the inductor is machined are not machined away to the same extent as in the earlier embodiments. This provides for the inductor block portions of inductor 276 have areas laterally outwardly and above the coolant passageways therethrough, and these areas are provided with openings 308 therethrough which are in alignment with openings 274 in the corners of recesses 256 in end plates 250. Further, mounting lugs 280 of the inductor are provided with openings 308 therethrough which are aligned with the opening 274 in the laterally outer ends of the corresponding recesses 270 in the side plates. Side plates 250 can be joined together with the inductor and other components therebetween in the same manner as side plates 26 and 28 in the earlier embodiment, and the upper and lower positioning shoes 282 and 284 can be secured between the side plates by fasteners as described in connection with the earlier embodiment. In the present embodiment, however, inductor 276 is positioned and stabilized relative to side plates 250 by stainless steel dowels 310 which extend through the corresponding aligned openings 274 and 308 in the side plates and inductor to restrain displacement of the inductor relative to the side plates. Dowels 310 extend just short of the axially opposite outer faces of side plates 250 leaving recesses which are filled with epoxy flush with the outer sides of the plates. Thus, as in the earlier embodiment, the radially inner ends of positioning shoes 282 and 284 support the weight of the inductor assembly relative to the bearing surface being inductively heated, and dowels 310 accurately maintain the position of inductor 276 relative to the side plates and thus to the bearing surface being heated.

While considerable emphasis has been placed herein on the structures of the preferred embodiments of the inductor and inductor assembly and on the method of manufacturing the inductor and side plates, it will be appreciated that many changes can be made in the preferred embodiments and other embodiments devised without departing from the principles of the invention. In particular, it will be appreciated that the preferred embodiment of the inductor can be incorporated in an inductor assembly other than that provided by the side plates, positioning fingers, quenching chambers and quick disconnect coupling arrangement herein illustrated and described. Likewise, it will be appreciated that the inductor support arrangement and especially the machined side plate can advantageously accommodate and rigidly support an inductor other than the preferred inductor herein illustrated and described and, for example, an inductor of brazed tubular construction. These and other modifications as well as other embodiments of the invention will be obvious to those skilled in the art, whereby it is to be distinctly understood that the foregoing descriptive matter is to be interpreted merely as illustrative of the present invention and not as a limitation.

Having thus described the invention it is claimed:

1. A method of making an inductor for inductively heating a crankshaft bearing surface having an axis, comprising providing a block of electrically conductive material having upper and lower ends and axially opposite faces with respect to said axis, machining said block to provide an upper portion and a lower portion including first and second legs extending outwardly in laterally opposite directions relative to said upper portion, machining first recess means in one of said opposite faces including laterally spaced apart recesses in said upper portion and arcuate recesses in said first and second legs, machining second recess means in the other of said opposite faces including laterally spaced apart recesses in said upper portion and arcuate recesses in said first and second legs, said arcuate recesses in said first leg being axially opposed and said arcuate recesses in said second leg being axially opposed, drilling passages through said block between said opposed arcuate recesses, covering said first and second recess means for said passages and said first and second recess means to define coolant circuit means for connection to a coolant supply, machining said upper portion to provide an inverted U-shaped opening between said opposite faces inwardly adjacent said first and second recess means, machining a portion of each said first and second legs to an arcuate contour corresponding to said arcuate recesses therein, machining said block parallel to and between said opposite faces to provide a gap from the upper end of said block to a location in said first and second legs above said passages to form first and second inductor block portions, and cutting the upper portion of one of said inductor block portions to provide first and second terminal ends establishing an electrically conductive path through said first and second inductor block portions.

2. The method according to claim 1, and prior to said machining to provide said gap, machining another portion of said first and second legs to form mounting lugs for said inductor.

3. The method according to claim 1, and attaching first and second tubular conductor means respectively to said first and second terminal ends to extend upwardly therefrom.

4. The method according to claim 1, wherein said first recess means is in the face of the other of said first and second inductor block portions and includes end means opening laterally of said other inductor block portion, and attaching tubular coolant conduit means to said other inductor block portion in communication with said end means of said first recess means and extending laterally outwardly of said other inductor block portion.

5. The method according to claim 1, wherein said one inductor block portion is said second inductor block portion, said first recess means being in said first inductor block portion and including end means opening laterally thereinto, said laterally spaced apart recesses of said second recess means having first and second end means respectively opening from said first and second terminal ends, connecting coolant conduit means to said first inductor block portion in flow communication with said end means of said first recess means, and connecting first and second tubular conductor means respectively to said first and second terminal ends in flow communication with said first and second end means of said second recess means.

6. A method of making an inductor for inductively heating a crankshaft bearing surface having an axis, comprising providing a block of electrically conductive material having upper and lower ends and axially opposite faces with respect to said axis, machining first recess means in one of said opposite faces including first arcuate recess portions, machining second recess means in the other of said opposite faces including second arcuate recess portions axially aligned with said first arcuate recess portions, forming passages through said block between said first and second arcuate recess portions, covering said first and second recess means for said passages and said first and second recess means to define coolant circuit means for connection to a coolant supply, machining said block to an inverted generally U-shaped contour, first and second legs having an arcuate contour respectively corresponding to the contour of said first and second arcuate recess portions, machining said block parallel to and between said opposite faces from the upper toward the lower end of said block to form first and second inductor block portions including said first and second legs integrally joined at said lower end of said block, and slicing through the upper portion of one of said inductor block portions to provide terminal ends establishing an electrically conductive path through said inductor block portions.

* * * * *